US007811349B2

(12) United States Patent
Nguyen

(10) Patent No.: US 7,811,349 B2
(45) Date of Patent: Oct. 12, 2010

(54) VACUUM CLEANER WITH VORTEX STABILIZER

(75) Inventor: Tom Minh Nguyen, Grand Rapids, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 453 days.

(21) Appl. No.: 11/875,125

(22) Filed: Oct. 19, 2007

(65) Prior Publication Data

US 2008/0047091 A1 Feb. 28, 2008

Related U.S. Application Data

(63) Continuation-in-part of application No. PCT/US2006/026697, filed on Jul. 11, 2006.

(60) Provisional application No. 60/595,515, filed on Jul. 12, 2005, provisional application No. 60/596,263, filed on Sep. 12, 2005, provisional application No. 60/743,033, filed on Dec. 14, 2005.

(51) Int. Cl.
*B01D 45/12* (2006.01)

(52) U.S. Cl. ..... 55/426; 55/429; 55/459.1; 55/DIG. 3; 15/350; 15/353

(58) Field of Classification Search ..... 55/424, 55/426, 429, 459.1, DIG. 3; 15/350, 353
See application file for complete search history.

(56) References Cited

U.S. PATENT DOCUMENTS

| | | | | |
|---|---|---|---|---|
| 2,542,635 | A | 2/1951 | Archibald et al. | |
| 4,571,772 | A | 2/1986 | Dyson | |
| 6,221,134 | B1 | 4/2001 | Conrad et al. | |
| 6,524,358 | B2 | 2/2003 | Yang | |
| 6,579,334 | B2 | 6/2003 | Oh et al. | |
| 6,623,539 | B2 | 9/2003 | Lee et al. | |
| 6,746,500 | B1 | 6/2004 | Park et al. | |
| 7,651,544 | B1 * | 1/2010 | Fester et al. | 55/343 |
| 2002/0134059 | A1 | 9/2002 | Oh | |
| 2005/0132529 | A1 | 6/2005 | Davidshofer | |
| 2005/0138763 | A1 | 6/2005 | Tanner et al. | |
| 2006/0123590 | A1 | 6/2006 | Fester et al. | |

FOREIGN PATENT DOCUMENTS

| | | | |
|---|---|---|---|
| GB | 2369291 | A | 5/2002 |
| WO | 9742275 | A | 11/1997 |
| WO | 0160524 | A | 8/2001 |
| WO | 03030702 | A2 | 4/2003 |
| WO | 2007008772 | A2 | 1/2007 |

* cited by examiner

*Primary Examiner*—Robert A Hopkins
(74) *Attorney, Agent, or Firm*—McGarry Bair PC

(57) ABSTRACT

A vacuum cleaner with a cyclone module assembly comprises a cyclone separation chamber for separating dust and debris from air, a dirt cup for collecting dust and debris that is separated from the air in the cyclone separation chamber, and a vortex stabilizer. The vortex stabilizer can be pivotally mounted to the cyclone separation chamber to allow access to the cyclone separation chamber when the dirt cup is removed from the cyclone module assembly.

19 Claims, 23 Drawing Sheets

VACUUM CLEANER WITH VORTEX STABILIZER

CROSS REFERENCE TO RELATED APPLICATIONS

This application is a continuation-in-part of International Application No. PCT/US2006/026697, filed Jul. 11, 2006, which claims the benefit of U.S. Provisional Application Nos. 60/595,515, filed Jul. 12, 2005, 60/596,263, filed Sep. 12, 2005 and 60/743,033, filed Dec. 14, 2005, all of which are incorporated herein by reference in their entirety.

BACKGROUND OF THE INVENTION

1. Field of the Invention

The invention relates to suction cleaners, and in particular to suction cleaners having cyclonic dirt separation. In one of its aspects, the invention relates to a cyclone separator with a vortex stabilizer upon which a vortex is retained.

2. Description of the Related Art

Upright vacuum cleaners employing cyclone separators are well known. Some cyclone separators follow textbook examples using frusto-conical shape separators and others use high-speed rotational motion of the air/dirt to separate the dirt by centrifugal force. Typically, working air enters and exits at an upper portion of the cyclone separator as the bottom portion of the cyclone separator is used to collect debris. Furthermore, in an effort to reduce weight, the motor/fan assembly that creates the working air flow is typically placed at the bottom of the handle, below the cyclone separator.

BISSELL Homecare, Inc. presently manufactures and sells in the United States an upright vacuum cleaner that has a cyclone separator and a dirt cup. A horizontal plate separates the cyclone separator from the dirt cup. The air flowing through the cyclone separator passes through an annular cylindrical cage with baffles and through a cylindrical filter before exiting the cyclone separator at the upper end thereof. The dirt cup and the cyclone separator are further disclosed in the U.S. Pat. No. 6,810,557 which is incorporated herein by reference in its entirety.

U.S. Pat. No. 4,571,772 to Dyson discloses an upright vacuum cleaner employing a two stage cyclone separator. The first stage is a single separator wherein the outlet of the single separator is in series with an inlet to a second stage frusto-conical separator.

U.S. Patent Application Publication No. 2005/0138763 to Tanner et al. discloses an upright vacuum cleaner having a cyclone separator. A horizontal wall or platform inside the cyclone separator is of non-porous construction and acts as a central vortex return air platform because it does not contain any ports for the passage of air or dirt. In one embodiment, the wall is formed as part of a rotatable dirt cup lid.

SUMMARY OF THE INVENTION

A vacuum cleaner according the invention comprises a cleaning head assembly having a suction nozzle, a suction source, and a cyclone module assembly in fluid communication with the suction nozzle and the suction source. The cyclone module assembly comprises a cyclone separation chamber for separating dust and debris from air with the generation of a cyclonic airflow vortex forming a vortex tail, the cyclone separation chamber having an inlet opening in fluid communication with the suction nozzle through the working air path, an outlet opening for discharging cleaned air and a particle discharge outlet for discharging dust and debris separated from air, a dirt cup removably mounted to the cyclone separation chamber and in fluid communication with the particle discharge outlet for collecting dust and debris that is separated from the air in the cyclone separation chamber, and a vortex stabilizer to retain the vortex tail at a predetermined location with respect to the cyclone separation chamber.

In one embodiment of the invention, the vortex stabilizer is mounted with respect to the cyclone separation chamber for selective movement between a closed position at a predetermined location with respect to the cyclone separation chamber and an open position away from the closed position for access to the cyclone separation chamber for removal of accumulated dust and debris that remains in the cyclone chamber and on the vortex stabilizer after a cleaning operation.

In another embodiment, the vortex stabilizer is at least in part pivotally mounted to the cyclone separation chamber.

In accordance with another aspect of the invention, the vortex stabilizer is mounted on a support member that extends upwardly from a bottom surface of the dirt cup.

In accordance with yet another aspect of the invention, at least one of the size and orientation of the vortex stabilizer is adjustable with respect to the particle discharge outlet.

In accordance with still another aspect of the invention, the vortex stabilizer is flexible.

DESCRIPTION OF THE PREFERRED EMBODIMENT

Figure 1:
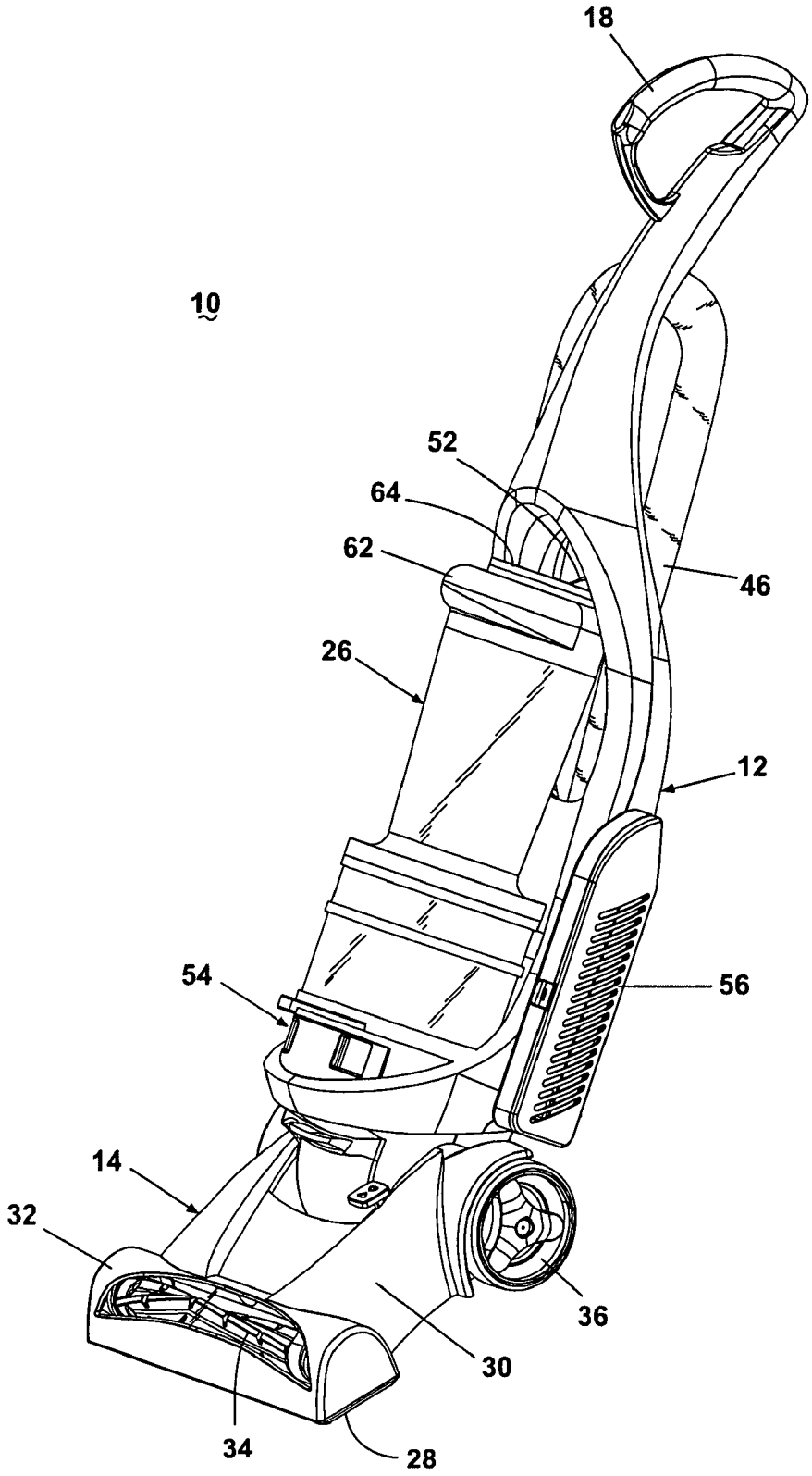
FIG. 1 is a perspective view of an upright vacuum cleaner with a cyclone module assembly according to the invention.
Figure 2:
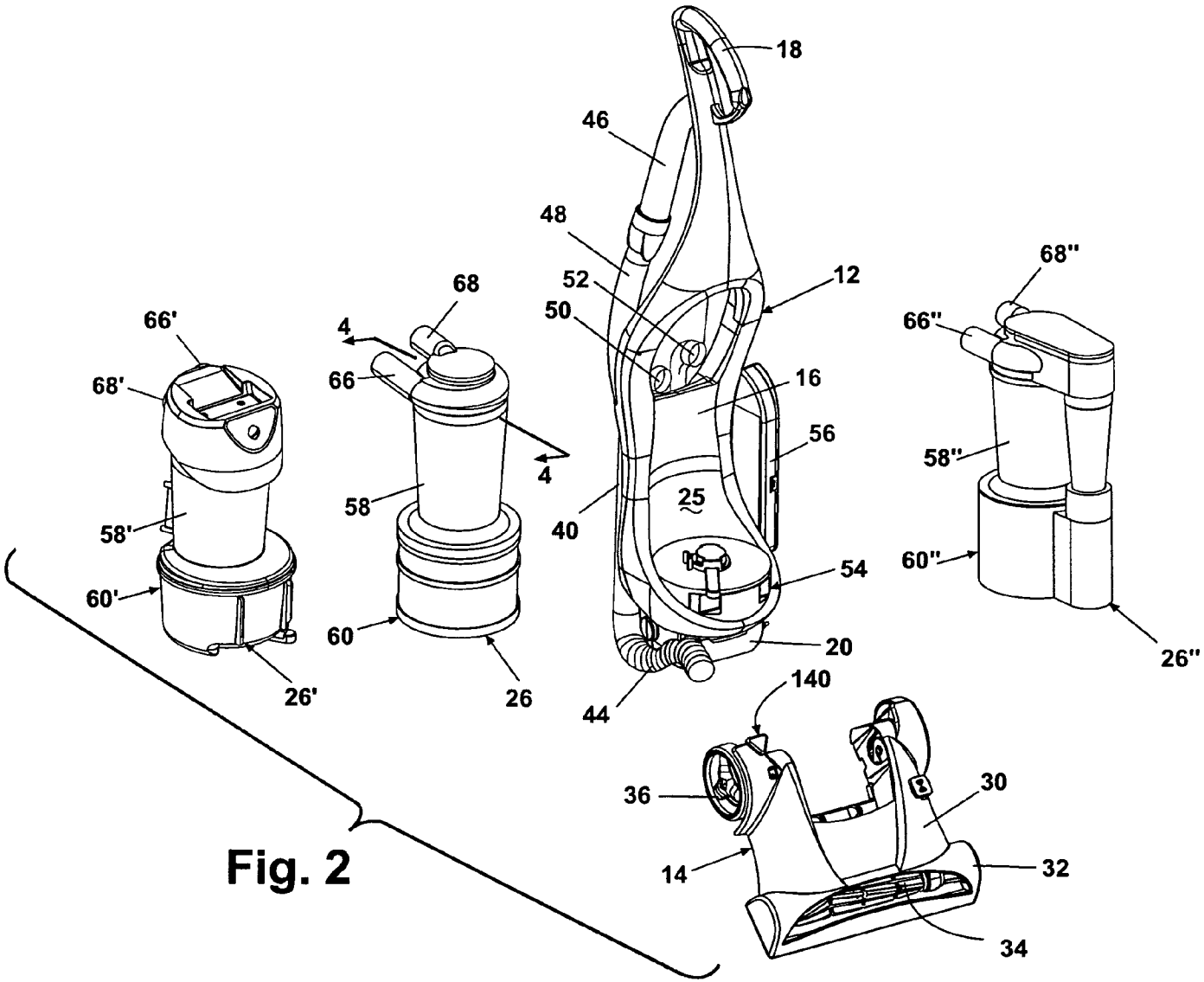
FIG. 2 is an exploded front quarter perspective view of the upright vacuum cleaner of FIG. 1 with three interchangeable cyclone module assemblies.
Figure 3:
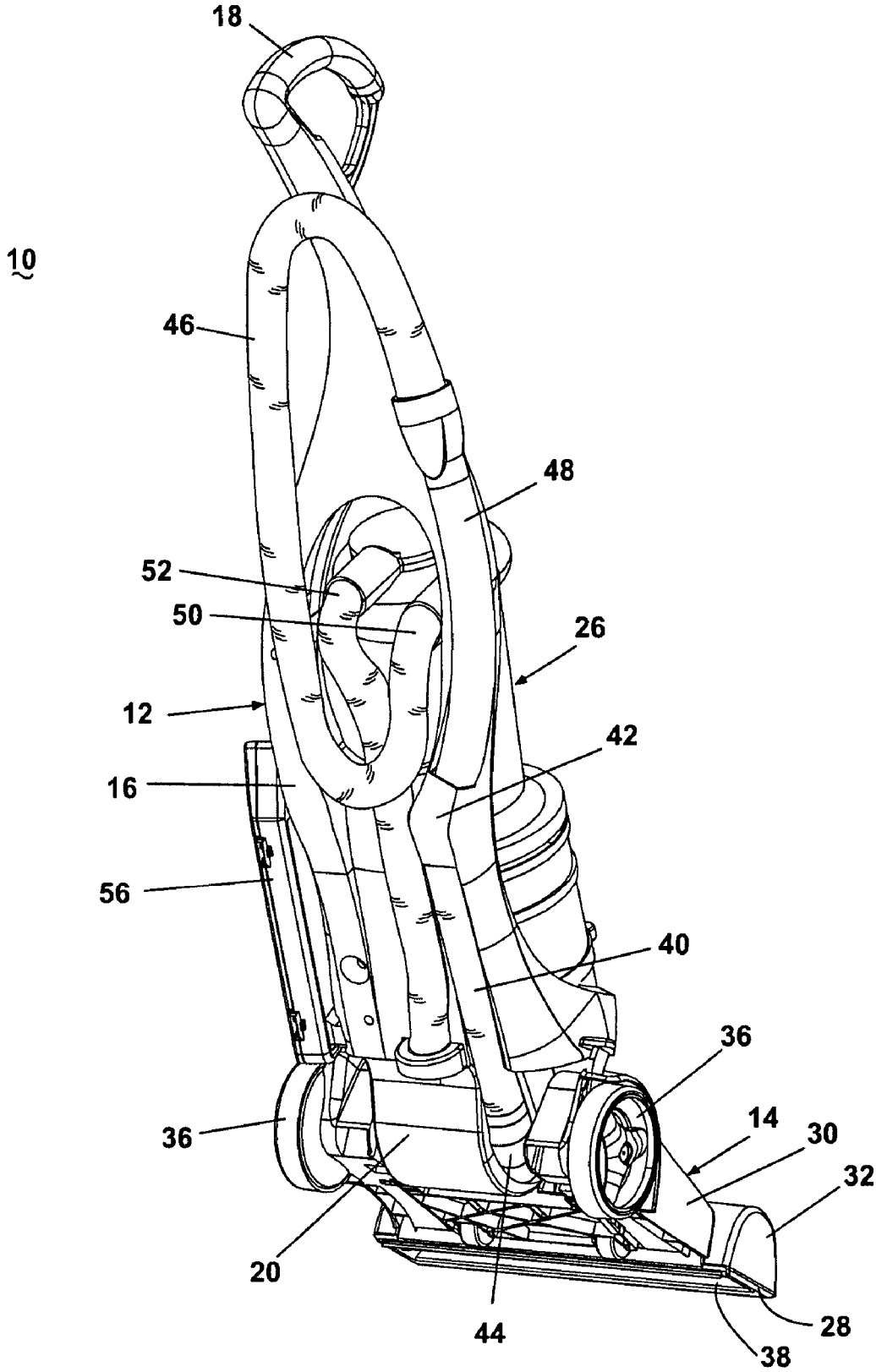
FIG. 3 is a rear quarter perspective view of the upright vacuum cleaner of FIG. 1.

An upright vacuum cleaner 10 according to the invention is shown in FIGS. 1-3 and comprises an upright handle assembly 12 pivotally mounted to a foot assembly 14. The handle assembly 12 further comprises a primary support section 16 with a grip 18 on one end to facilitate movement by the user. A motor cavity 20 is formed at an opposite end of the handle assembly and contains a commonly known fan/motor assembly (not shown) oriented transversely therein. The handle assembly 12 pivots relative to the foot assembly 14 through an axis formed relative to a shaft within the fan/motor assembly. The handle assembly 12 further receives one of a number of possible cyclone module assemblies 26, 26', 26" in a recess 25 provided on the primary support section 16. The cyclone module assemblies 26 separate and collect debris from a working air stream for disposal after the cleaning operation is complete. As shown herein, the vacuum cleaner 10 is provided with a single stage cyclone module assembly 26, a concentric two-stage cyclone module assembly 26', and a side-by-side two-stage cyclone module assembly 26", although additional cyclone module assemblies can be provided and other possible cyclone module configurations are contemplated. Also as shown herein, the vacuum cleaner is provided with one foot assembly 14, although it is contemplated that a variety of foot assemblies 14 can be interchanged with the handle assembly 12 and other possible foot assembly configurations can be utilized. The modular nature of the vacuum cleaner 10 allows for flexibility in manufacturing so that a variety of different models with different features and options can be assembled from any combination of cyclone module assemblies 26, 26', 26" and foot assemblies 14 on to a common handle assembly 12. This flexibility in assembly allows for an entire product line that varies from low end models with very few features to high end models with many features and improved separation efficiencies to be produced in a cost effective manner.

The foot assembly 14 further comprises a lower housing 28 that mates with an upper housing 30 to form a brush chamber 32 in a forward portion thereon. A rotating brush roll assembly 34 is positioned within the brush chamber 32 as will be described in more detail herein. A pair of rear wheels 36 is secured to a rearward portion of the foot assembly 14, rearward being defined relative to the brush chamber 32. A variety of different foot assembly 14 configurations can be assembled to the handle assembly 12 that comprise various features. Typically, the foot assembly 14 can vary in width so that the cleaning path can be narrower or wider depending upon the size of the brush chamber 32.

A suction nozzle 38 is formed at a lower surface of the brush chamber 32 on the foot assembly 14 and is in fluid communication with the surface to be cleaned. A foot conduit 40 provides an air path from the suction nozzle 38 through the foot assembly 14 and terminates in a wand interface 42. In the preferred embodiment, the foot conduit 40 is a smooth rigid blow molded tube with a bendable portion 44 that coincides with the pivot point between the foot assembly 14 and the handle assembly 12 to allow the handle assembly 12 to pivot with respect to the foot assembly 14. In an alternate embodiment, the foot conduit 40 is a commonly known flexible hose typically used in the vacuum cleaner industry. In yet another embodiment, the air path is formed by and between the housings 28, 30 with no secondary blow molded or flexible hose parts.

A height adjustment actuator 140 is provided on the rearward portion of the foot assembly and operates a height adjustment mechanism (not shown) such as is commonly used to adjust the vertical position of the suction nozzle relative to a floor surface. An example of a suitable height adjustment mechanism is described in U.S. Pat. No. 6,256,833 and in U.S. Provisional Patent Application No. 60/596,263, filed Sep. 12, 2005 and titled "Vacuum Cleaner with Cyclonic Dirt Separation," both of which are incorporated herein by reference in their entirety. Other details common to foot assemblies are further described in these references.

A live hose 46 comprises a fixed wand connection 48 on one end and a cyclone inlet receiver 50 on the other end. The live hose 46 is preferably a commonly known flexible vacuum hose. The cyclone inlet receiver 50 is fixed to an upper portion of the primary support section 16 of the handle assembly 12. The wand connection 48 is removably received in the wand interface 42 via a friction fit or, alternatively a bayonet latch so as to create an air tight seal when the wand connection 48 is inserted therein. The live hose 46 is managed via a pair of commonly known hose hooks (not shown) at a lower portion of the primary support section 16 and near the grip 18 as is commonly known in the vacuum industry. A live hose is one in which the working air always passes through the hose 46 whether the vacuum cleaner 10 is being operated in the floor mode, where the working air enters the vacuum cleaner 10 through the suction nozzle 38 or the above floor mode where the working air enters the cleaner through the wand connection 48.

A cyclone outlet receiver 52 is formed on an upper portion of the primary support section 16 in close proximity to the cyclone inlet receiver 50 and is in fluid communication with a pre-motor filter assembly 54 positioned upstream of an inlet to the fan/motor assembly 22 (FIG. 4) located in the motor cavity 20 and a working air exhaust assembly 56. Fluid communication can be accomplished by an air path (not shown) integrally formed in the primary support section 16 or can be a rigid blow molded tube or a commonly known flexible vacuum hose.

Figure 4:
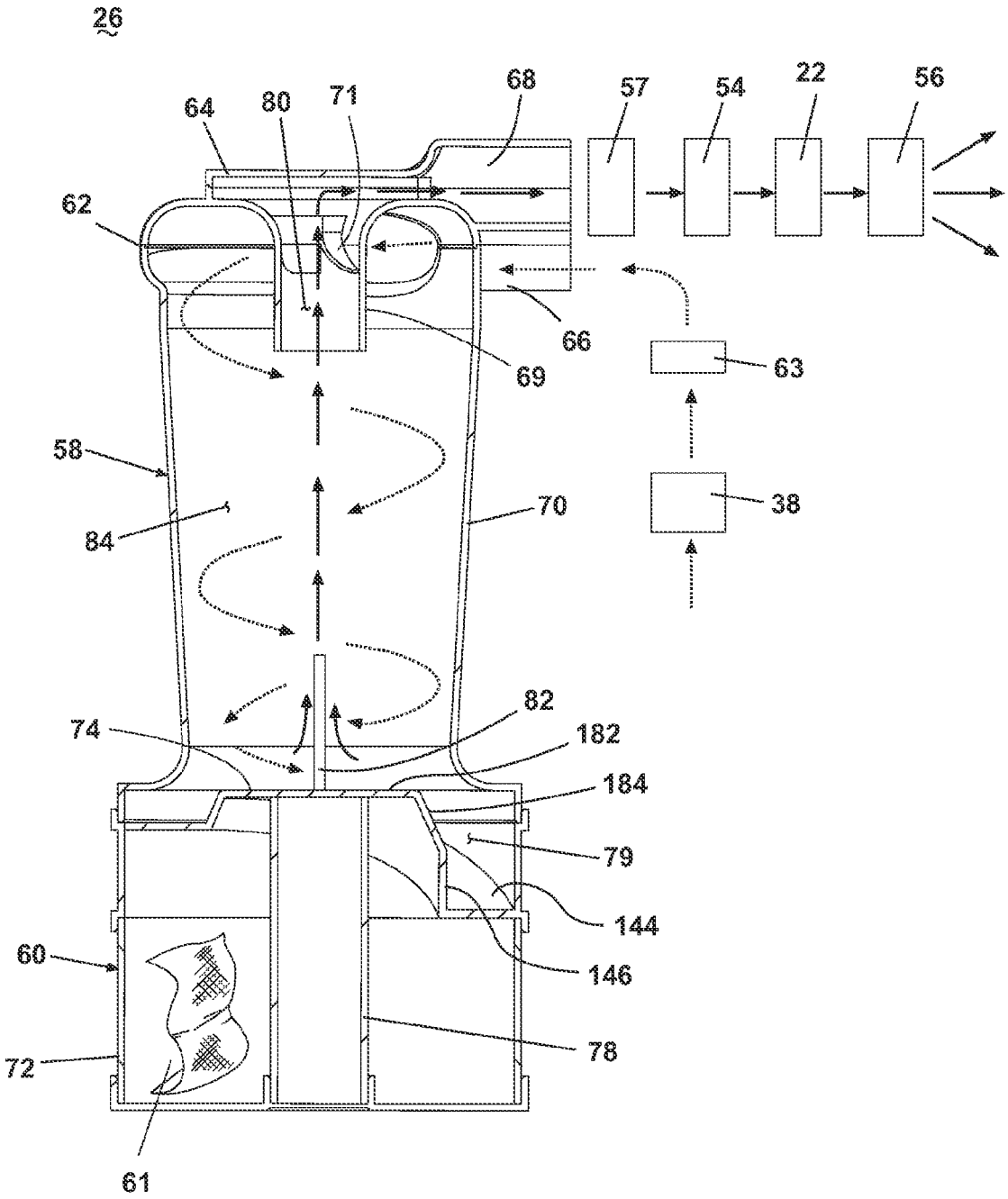
FIG. 4 is a cross-sectional view of one embodiment of a single stage cyclone module assembly taken through line 4-4 of FIG. 2.

Referring to FIG. 4, a first embodiment of the single stage cyclone module assembly 26 comprises a cyclone separation housing 58 and a dirt cup assembly 60. The cyclone separation housing 58 further comprises a cyclone housing 70 defining a single separator 84, a cyclone inlet housing 62 and a cyclone diffuser housing 64, all three being fixedly attached to each other to create an air tight seal between them. The cyclone housing 70 has a frustoconical shape, tapering from a larger diameter at an upper portion to a smaller diameter at a lower portion, and further wherein the cyclone separation chamber flares outwardly beneath the tapering lower portion.

The interior space of the cyclone housing 70 is unobstructed so that air can flow freely therein. In a preferred embodiment the cyclone housing 70 is made of a transparent material so that the separation action within is visible to the user. The inlet housing 62 further comprises a cyclone inlet 66 that sealingly mates with the cyclone inlet receiver 50 on the primary support section 16. Optionally, a cylindrical cup with slots can be rotatably mounted within the cyclone outlet 68. Air flowing through the slots causes the cylindrical cup to spin, inhibiting debris from passing therethrough while having a negligible effect on airflow.

Furthermore, a vortex finder 69 is formed by a circular wall around an outlet aperture 80 centrally formed in an upper surface of the inlet housing 62. Optionally, a flow straightener 71 may be positioned within the outlet aperture 80 to remove the rotational flow of the airstream exiting the cyclone module assembly 26 which reduces the pressure drop across the cyclone module assembly 26.

The dirt cup assembly 60 further comprises a dirt cup housing 72, and a vortex stabilizer surface 74 that can be positioned inside or outside the cyclone housing 70 provided that the separator 84 is configured such that a vortex tail formed by the airflow through the cyclone separation housing 58 contacts the vortex stabilizer surface 74. The vortex stabilizer surface 74 can be rigid, or in an alternate embodiment, the vortex stabilizer surface 74 can be made of a flexible thermoplastic or elastomeric material. In one embodiment, the vortex stabilizer surface 74 is integrally formed with a gasket (not shown) between the cyclone housing 70 and the dirt cup housing 72. An advantage of the flexible elastomeric material is that the vortex stabilizer surface 74 can vibrate and move in response to the vortex forces present during operation. The vibration and movement of the vortex stabilizer surface 74 can dislodge debris that may collect on the surface and fall into the dirt cup assembly 60, thus automatically cleaning the surface 74.

Figure 6:
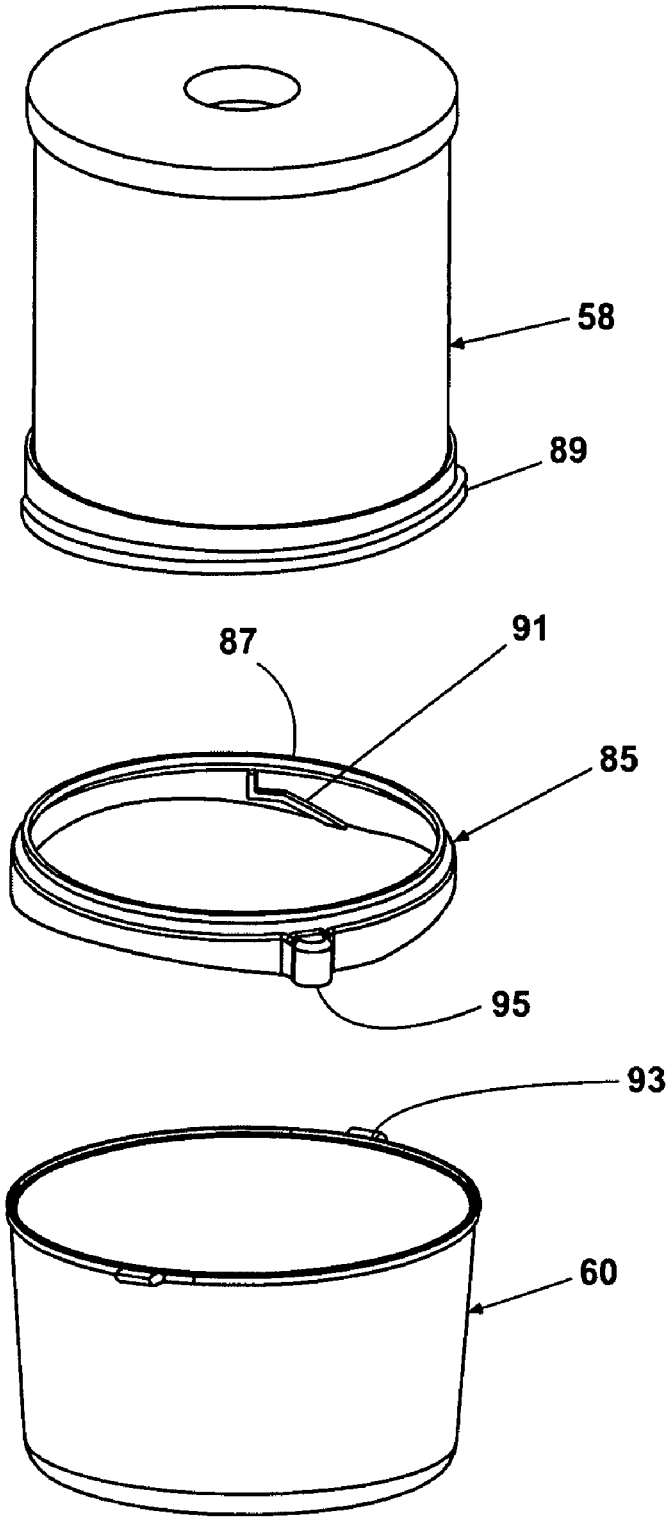
FIG. 6 is a perspective view of a dirt cup assembly locking ring.
Figure 9:
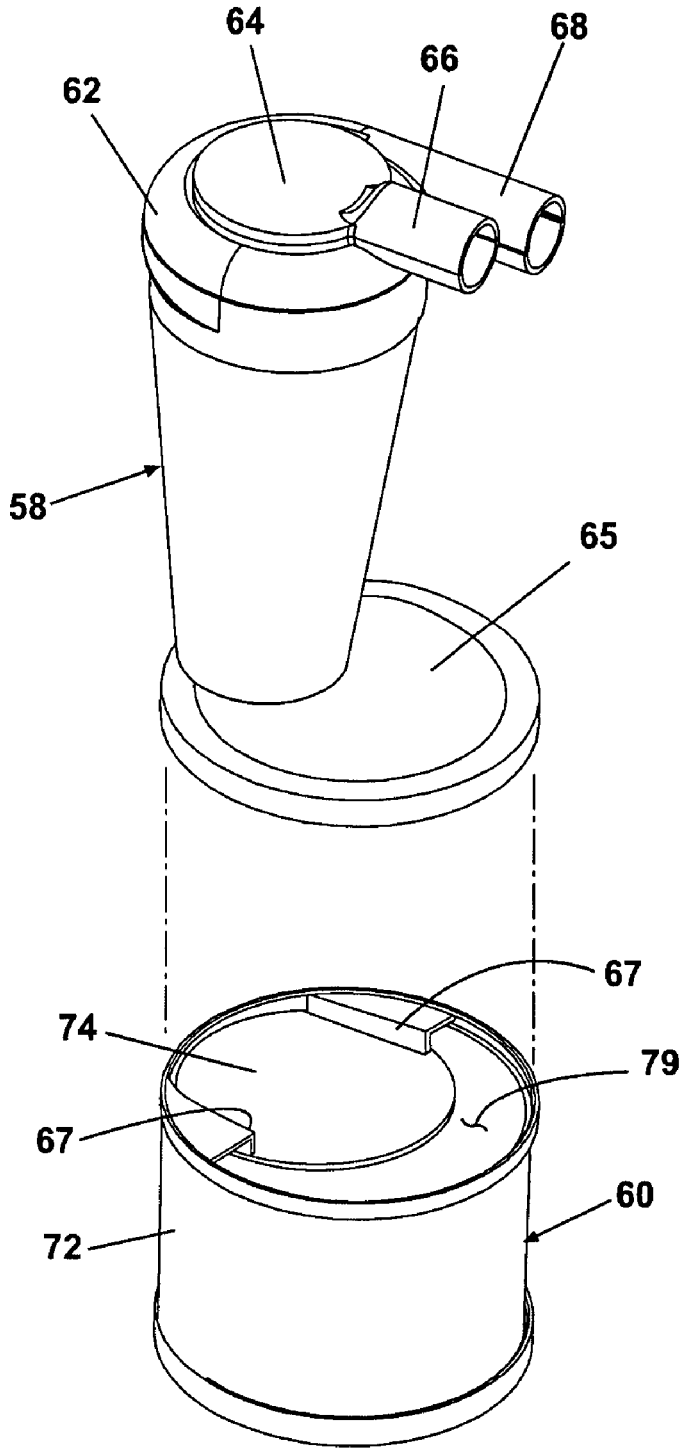
FIG. 9 is an exploded perspective view of a third embodiment of a single stage cyclone module assembly.

As illustrated in FIG. 4, the vortex stabilizer surface 74 is spaced upwardly from the bottom of the dirt cup housing 72 by a vortex stabilizer support 78. However, the vortex stabilizer surface 74 can be located anywhere between the bottom of the dirt cup housing 72 and the vortex finder 69. Preferably, the vortex stabilizer surface 74 is positioned at or near the bottom plane of the cyclone housing 70, as shown in FIGS. 4, 6 and 9. As illustrated, the vortex stabilizer surface 74 includes a generally flat plate 182 coupled to the support 78 and having a downwardly-angled rim 184 at the outer edge of the plate 182. The plate 182 has a diameter less than that of the dirt cup housing 72.

The vortex stabilizer surface 74 provides a dedicated location for the cyclone vortex tail to attach, thus minimizing the walking or wandering effect that might otherwise occur in the absence of a vortex stabilizer surface 74. Controlling the location of the vortex tail improves separation efficiency of the cyclone separation housing 58 and further prevents reintrainment of dirt already separated and deposited in the dirt cup assembly 60.

Optionally a vortex stabilizing rod 82 can be located vertically on the vortex stabilizer surface 74 to further stabilize the vortex tail. Any combination of stabilizer surface 74 and stabilizing rod 82 can be utilized to effectively stabilize the vortex tail. Alternatively, the stabilizing rod 82 can be attached to a lower surface of the cyclone diffuser housing 64 or the vortex finder 69 and depend for any distance from the bottom of the cyclone housing 70 but no more than to a position at the upper end of the dirt cup housing 72. A debris outlet 79 is formed between the vortex stabilizer surface 74 and an inner wall of the cyclone housing 70 through which debris separated by the cyclone separation housing 58 can pass to the dirt cup assembly 60. As illustrated in FIG. 4, the outlet opening 79 is formed by a ramped surface 144 and a helical side wall 146. The helical side wall 146 can be connected to the downwardly-angled rim 184 of the vortex stabilizer surface 74. In an alternate embodiment, the dirt cup assembly 60 or lower portion of the cyclone housing 70 can also include additional fine debris receptacles as more fully described in U.S. Patent Application No. 60/552,213, filed Sep. 1, 2004 and entitled "Cyclone Separator with Fine Particle Separation Member", which is incorporated herein by reference in its entirety.

As shown by the arrows in FIG. 4, dirty working air is drawn through the suction nozzle 38 and enters the cyclone separator assembly 26 tangentially through the cyclone inlet 66. A vortex is formed, where the cyclone inlet housing 62 directs the air in a helical direction downward and tangentially along an inner surface of the cyclone housing 70. As the dirty air rotates within the cyclone housing 70, the debris is thrown outward and downward toward the cyclone housing wall 70 and remains in the swirling air path until the airflow abruptly changes direction at the bottom of the cyclone towards the outlet aperture 80 and inertial forces carry the debris into the dirt cup housing 72 below. The swirling air forms a vortex tail that attaches to the vortex stabilizer surface 74 where the airflow then turns abruptly in a vertical direction directly towards the vortex finder 69 formed by the outlet aperture 80 and out the cyclone diffuser housing 64 through a cyclone outlet 68. The vortex in the cyclone housing 70 also creates an induced vortex within the dirt cup housing 72. The swirling air within the dirt cup housing 70 likewise throws debris toward the outer wall of the dirt cup housing 70 resulting in additional separation and the ability of the dirt cup housing 72 to collect additional debris up to and above the debris outlet 79 without any appreciable re-entrainment. Relatively clean air then passes through the pre-motor filter assembly 54, the motor/fan assembly 22, and finally through the working air exhaust assembly 56.

Optionally, an inlet air relief valve 63 comprising a commonly known spring biased valve can be positioned on the cyclone assembly 58 that opens when air flow through the normal working air path becomes blocked, as can sometimes happen at the suction nozzle 38 or the live hose 46. The relief valve 63 is sized to allow sufficient air flow to continue through the cyclone assembly 58 so that debris already separated does not become reentrained due to slower, interrupted air flow.

Yet another option is to include a commonly known particle counter 57 between the cyclone outlet 68 and the pre-motor filter assembly 54 to sense when dust and debris is passing through the cyclone assembly 58. This can provide an early indication to the user that the cyclone module assembly 26 is experiencing a malfunction that inhibits separation in the working air and can lead to severe pre-motor filter assembly 56 clogging and possible damage to the fan/motor assembly 22 giving the user the ability to empty the dirt cup assembly 60 and clear the working air path of clogs before continuing use. A suitable infra-red particle counter 57 is more fully described in U.S. Pat. No. 4,601,082, which is incorporated herein by reference in its entirety.

Still another option is to add a flexible sheet 61 with anti-static properties to the dirt cup assembly 60 during operation. The anti-static sheets 61 reduce dust emission from the vacuum during use and also collect stray dust particles within the dirt cup assembly 60 to minimize spilling when the dirt cup assembly 60 is emptied. Additionally, the sheets 61 can be scented to improve odor control. Suitable anti-static sheets are commercially available in the form of clothes dryer anti-static sheets.

Figure 5:
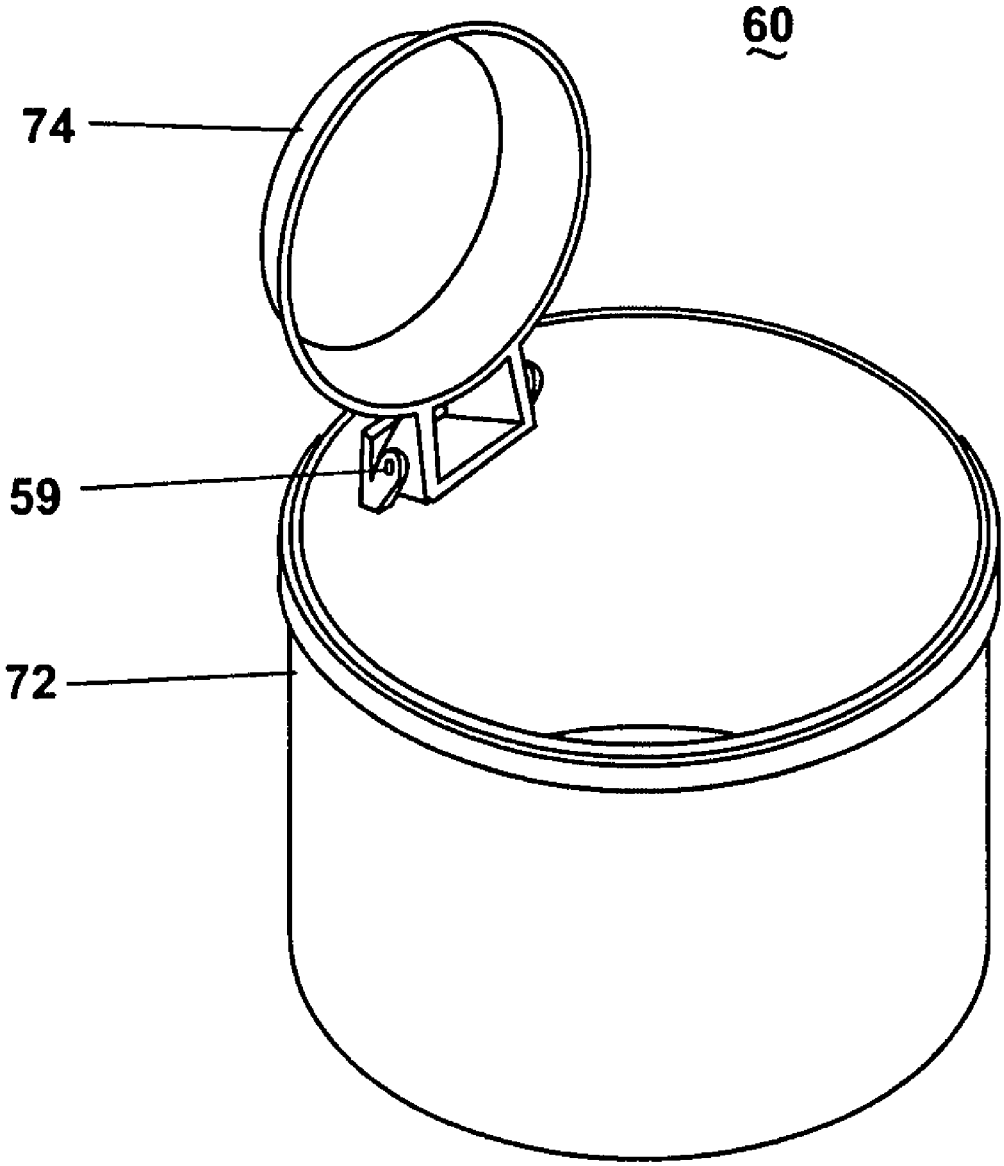
FIG. 5 is a perspective view of an alternate embodiment of a vortex stabilizer shown in the open position for emptying.

Referring to FIG. 5, an alternate embodiment of the vortex stabilizer 74 is shown where like features are indicated with the same numbers. The vortex stabilizer surface 74 is pivotally attached to the side wall of the dirt cup housing 72 via a commonly known hinge 59. A hinged attachment to the sidewall of the dirt cup housing 72 pivotally mounts the vortex stabilizer surface 74 to the side wall so that it can be pivoted upwardly from a functional horizontal position beneath the cyclone separator as, for example, illustrated in FIG. 4, to an out of the way position as illustrated in FIG. 5 so that debris accumulated in the dirt cup housing 72 can pass out of the dirt cup housing 72 unimpeded when the dirt cup housing 72 is inverted, for example, when emptying debris collected in the dirt cup housing 72. As can be appreciated, any geometry utilized for the vortex stabilizer surface 74 including those described herein, can be adapted with a hinge 59 as described. The pivoting vortex stabilizer 74 can be incorporated into any of the embodiments of the cyclone module assemblies 26, 26', 26" shown herein.

Referring to FIG. 6 in an alternate embodiment of the dirt cup assembly 60 is shown, where like features are indicated with the same numbers. A locking ring 85 comprises an annular groove 87 that circumferentially mates with an annular rib 89 formed on an outer lower surface of the cyclone separation housing 58. An inner surface of the locking ring 85 further comprises releasable interlocking fasteners in the form of at least two horizontally opposed fingers 91 (only one of which is shown in FIG. 6) that have upper ramped surfaces that releasably support a corresponding number of locking tabs 93 formed on an upper outer surface of the dirt cup assembly 60. The ramped fingers 91 are formed so that the locking tabs 93 initially contact the ramped fingers 91 at a bottom end thereof. As the user rotates the locking ring 85 via a user interface 95 such as a lever or grip formed thereon, the locking tabs 93 ride up and within the ramped surfaces 91 and therefore raise the dirt cup assembly 60 up into sealing contact with the locking ring 85. Any of the embodiments of the cyclone module assemblies 26, 26', 26" shown herein can be modified to incorporate the locking ring 85 between the dirt cup assembly 60 and the cyclone separation housing 58.

Figure 7:
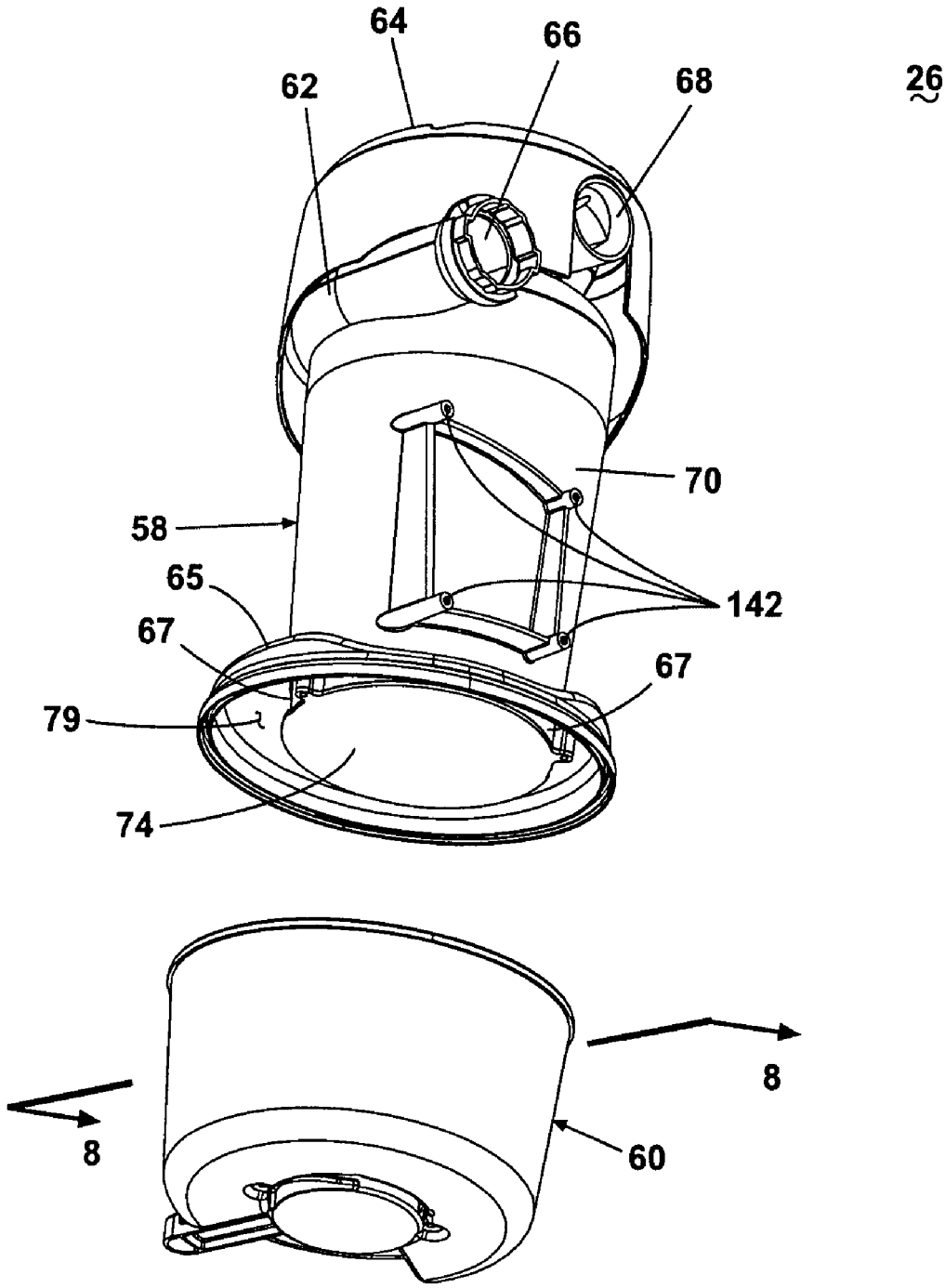
FIG. 7 is an exploded perspective view of a second embodiment of a single stage cyclone module assembly.
Figure 8:
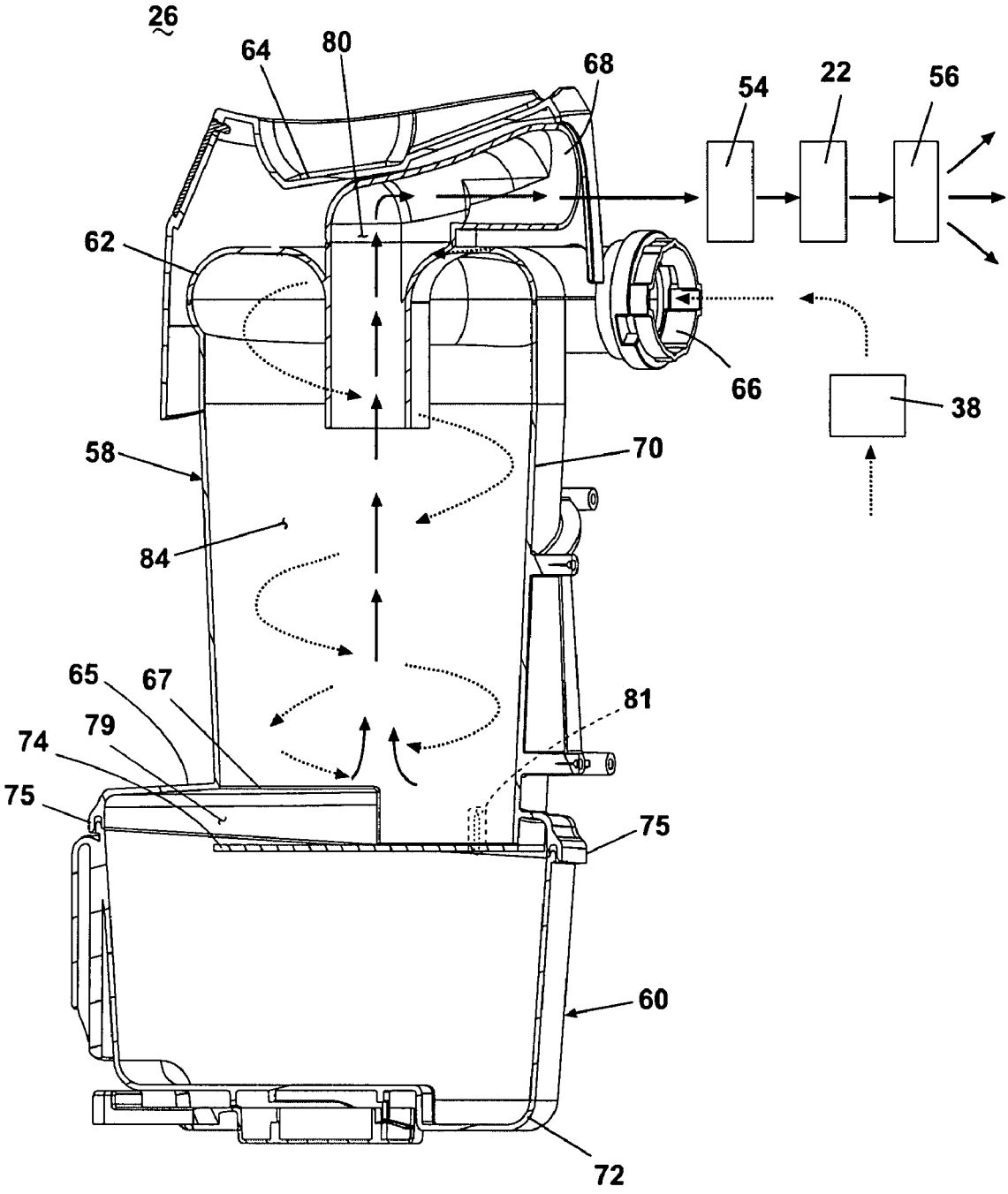
FIG. 8 is cross-sectional view of the single stage cyclone module assembly shown in FIG. 7, taken through line 8-8 of FIG. 7.

Referring to FIGS. 7 and 8, a second embodiment of the single stage cyclone module assembly 26 is shown, where like features are indicated with the same numbers. The cyclone module assembly 26 comprises a tapered cyclone separation housing 58 that is oriented so that the longitudinal axes of the cyclone separation housing 58 and dirt cup assembly 60 are offset from each other. The cyclone separation housing 58 longitudinal axis can be vertical or can be inclined from vertical. A dirt cup lid 65 can be integrally formed with a bottom surface of the cyclone separation housing 58 and can sealingly mate with an upper edge of the dirt cup assembly 60. Alternatively, the dirt cup lid 65 can be a separate piece or can be removably attached or hinged to the dirt cup assembly 60.

The vortex stabilizer surface 74 can be integrally formed with a lower portion of the cyclone housing 70 or can be supported by vertical walls 67 that depend from the dirt cup lid 65. In this embodiment, the vortex stabilizer surface 74 is affixed to the cyclone housing 70 via a screw 81 such the vortex stabilizer surface 74 stays with the cyclone housing 70 when the dirt cup housing 72 is removed, thus leaving the dirt cup assembly 60 totally clear from obstructions that may interfere with emptying the debris contained therein. A lip 75 is formed on the dirt cup lid 65 that extends below the vortex stabilizer surface 74. The lip 75 sealingly engages with an upper edge of the dirt cup housing 72.

The vortex stabilizer surface 74 is asymmetrically oriented with respect to the dirt cup assembly 60 central axis to maximize the size of the debris outlet 79. In a preferred embodiment, the vortex stabilizer surface 74 is spaced from a bottom surface of the cyclone separation housing 58 so that a gap forming the debris outlet 79 is formed therewith. Experimentation has shown that a gap formed across no more than l/2 the stabilizer perimeter optimizes debris transfer from the bottom of the cyclone separator into the dirt cup assembly 60. Preferably, the vortex stabilizer surface 74 is configured to be slightly smaller in diameter than the opening at the bottom of the cyclone housing 70 so that the vortex stabilizer surface 74 can be molded together with the cyclone housing 70 as a single molded part. However, the vortex stabilizer surface 74 can be larger or smaller than the cyclone housing 70 opening to optimize performance.

Referring to FIG. 9, a third embodiment of the single stage cyclone module assembly 26 is shown, where like features are indicated with the same numbers. The cyclone module assembly 26 comprises a tapered cyclone separation housing 58 that is oriented so that the longitudinal axes of the cyclone separation housing 58 and dirt cup assembly 60 are offset. The vortex stabilizer surface 74 is mounted to an upper edge of the dirt cup housing 72 and is asymmetrically oriented with respect to the dirt cup housing 72 center axis to maximize the size of a debris outlet 79. The vortex stabilizer surface 74 can further be supported by a pair of brackets 67*a* that extends from the dirt cup housing 72 upper edge to the vortex stabilizer surface 74. In the preferred embodiment, the vortex stabilizer surface 74 is spaced from a bottom surface of the cyclone separation housing 58 so that a gap forming the debris outlet 79 is formed therewith. Moving the vortex stabilizer surface 74 to the side of the dirt cup assembly 60 provides adequate clearance space to easily empty the dirt cup assembly 60 through the debris outlet 79.

It has been found that airflow characteristics through the cyclone separator can be varied by changing the size and orientation of the vortex stabilizer surface 74. With reference to FIG. 9 experimentation has shown that rotating the dirt cup assembly 60 relative to the cyclone separation housing 58 changes the size, shape, and location of the debris outlet 79 gap and affects pressure drop, air flow, and other performance aspects of the cyclone separation housing 58. Furthermore, airflow characteristics are known to change when the orientation of the tangential cyclone inlet 66 of the cyclone inlet housing 62 is varied relative to the debris outlet 79. It can be desirable, for example, to use a higher airflow rate to more efficiently separate fine particles in the airstream. However, it is more advantageous to use lower airflow rates in order to adequately separate larger, light debris from the airstream. The vortex stabilizer 74 can be made to be user adjustable so that a user can select the desired cyclone setting based upon the type of debris to be picked up.

Figure 10:
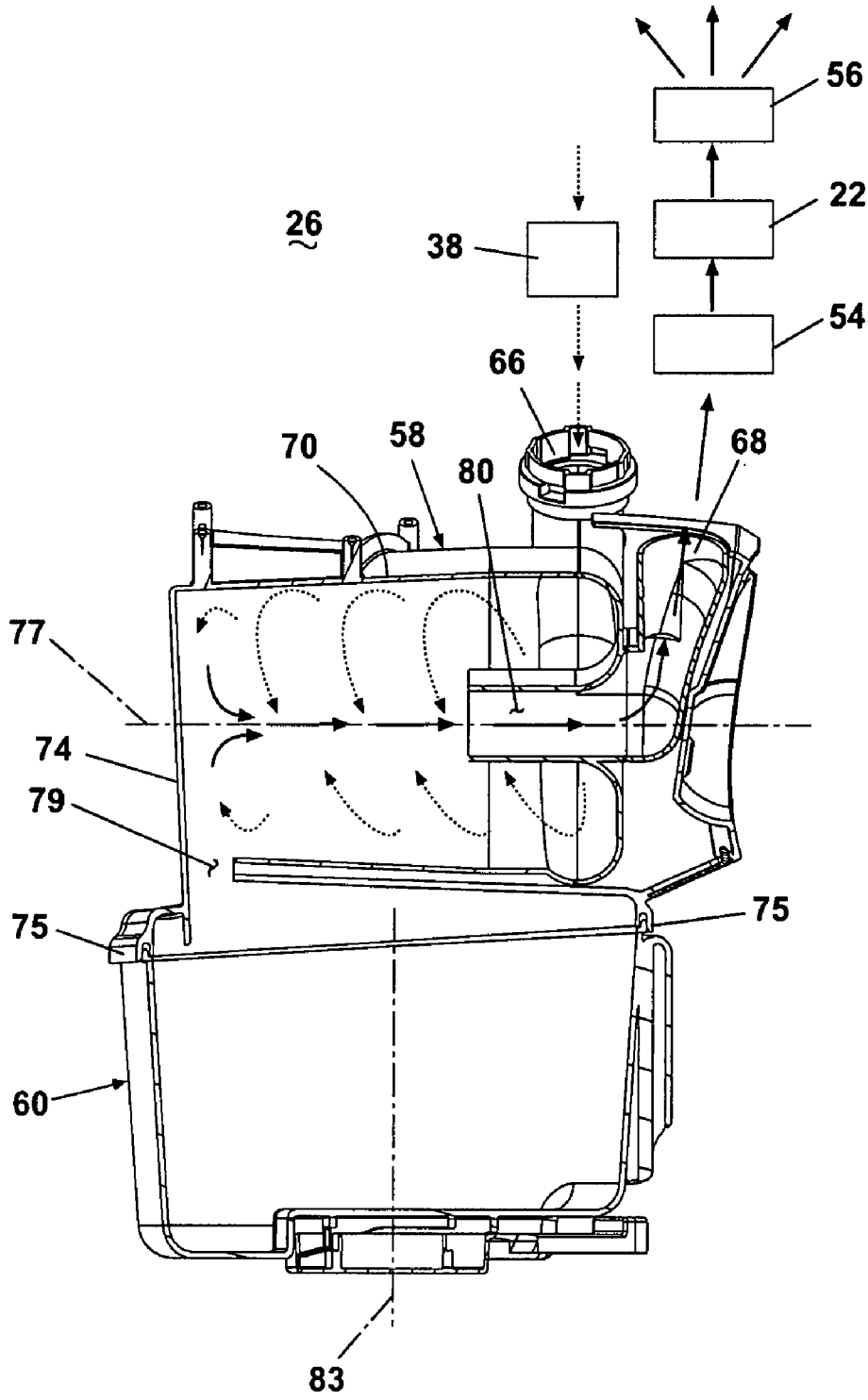
FIG. 10 is a cross-sectional view of a fourth embodiment of a single stage cyclone module assembly.

Referring to FIG. 10, a fourth embodiment of the single stage cyclone module assembly 26 is shown, where like features are indicated with the same numbers. A longitudinal axis 77 of the cyclone separator housing 70 is positioned horizontally and transverse of perpendicular to a vertical longitudinal axis 83 through the dirt cup housing 72. The debris outlet 79 is oriented generally perpendicular to the longitudinal axis 77. A vortex stabilizer surface 74, as previously described, forms a bottom of the cyclone housing 70 and is generally parallel to the vertical axis 83 of the dirt cup assembly 60. When the cyclone module assembly 26 is installed in the handle assembly 12, the longitudinal axis 77 is in a generally horizontal orientation relative to a floor surface where the dirt cup assembly 60 is below the horizontal cyclone separation housing 58 and the debris outlet 79 is oriented downwardly. When this cyclone separation module is mounted on an upright vacuum cleaner as illustrated in FIG. 1, the orientation of the longitudinal axis 77 rotates downwardly at an acute angle to the horizontal as the handle assembly tilts downwardly during normal vacuum cleaner operation. This configuration minimizes the vertical height of the cyclone module assembly 26 and shortens the air flow ducting from the suction nozzle 38 to the cyclone inlet receiver 50 and from the cyclone outlet receiver 52 to the fan/motor assembly 22.

A further advantage of incorporating the vortex stabilizer surface 74 in any of the described embodiments is that the length of the cyclone housing 70 can be shortened to create a compact cyclone separation module. Given a fixed volume of space available to locate the cyclone separation housing 58 on the handle assembly 12, a compact cyclone separation module leaves more room for the dirt cup assembly 60 and thus a larger dirt cup assembly 60 with greater dirt collection capacity can be used.

Furthermore, any of the vortex stabilizers 74 described herein can be designed to be moveable along the longitudinal axis of the cyclone separation housing 58. It has been found that varying the length of the cyclone vortex changes the separation efficiency by changing the airflow and pressure drop characteristics across the cyclone separator. As described above, this characteristic can be utilized to create user adjustability depending upon the type of debris to be removed from the surface.

Figure 11:
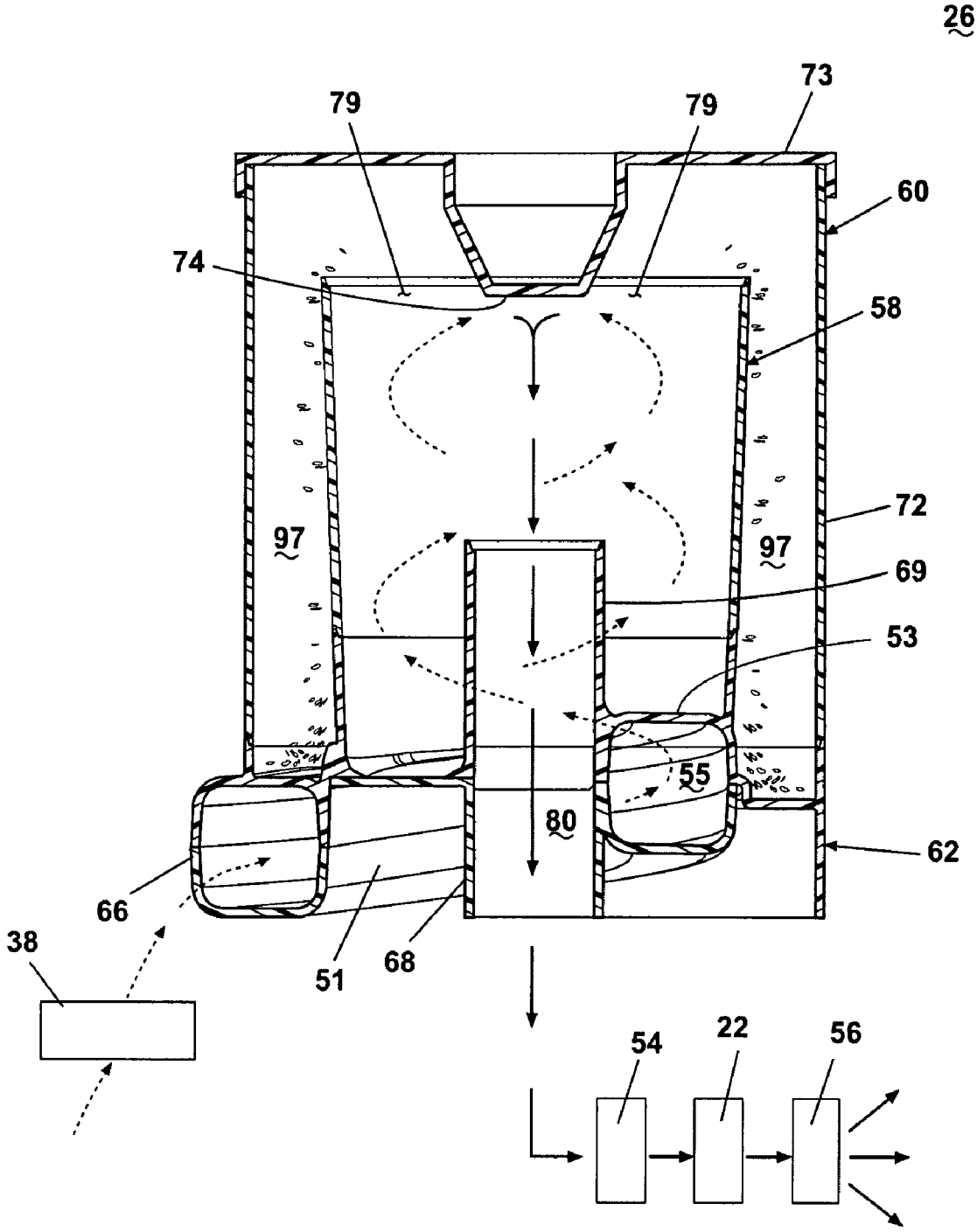
FIG. 11 is a cross-sectional view of a fifth embodiment of a single stage cyclone module assembly.
Figure 12:
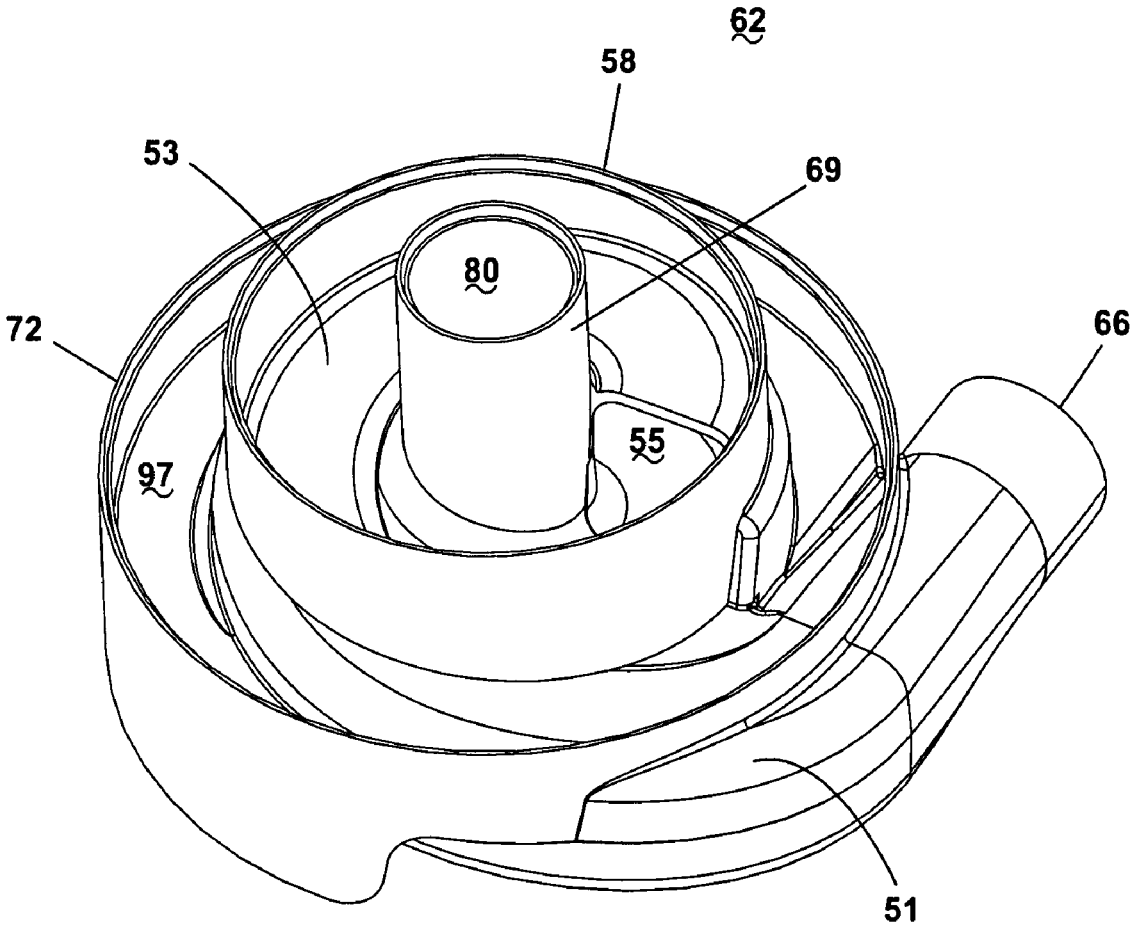
FIG. 12 is top perspective view of a cyclone inlet housing of FIG. 11.

Referring to FIGS. 11 and 12 a fifth embodiment of the single stage cyclone module assembly 26 is shown, where like features are indicated with the same numbers. The cyclone module assembly 26 comprises a cyclone separation housing 58 wholly within the dirt cup assembly 60 and a cyclone inlet housing 62 outside of the dirt cup assembly 60, both being fixedly attached to each other in sealed relationship to create an air tight seal between them. The inlet housing 62 further comprises a cyclone inlet 66 that sealingly mates with the cyclone inlet receiver 50 (FIG. 2) on the primary support section 16. The inlet housing 62 further comprises a scroll section 51 that forms a generally helical approach to a tangential inlet 55 of the cyclone separation housing 58. An upper wall of the scroll section 51 forms a ramp 53 that forms a bottom surface of the cyclone separation housing 58. The cyclone module assembly 26 is oriented such that the cyclone inlet housing 62 is positioned at the bottom of the module, thus forming a bottom inlet and outlet configuration. The dirt cup assembly 60 is formed by the dirt cup housing 72 that creates a generally circular perimeter wall, with a bottom surface formed by the ramp 53 and a sealed top surface formed by a removable dirt cup top 73. A dirt collection region 97 is defined between the dirt cup housing 72 and the cyclone separation housing 58. The dirt cup top 73 further comprises a vortex stabilizer surface 74 as previously described that is formed on the end of a projection 73 a that extends downwardly from the upper surface of the top 73 and into the upper portion of the cyclone separation chamber. A vortex finder 69 is formed by a circular wall around an outlet aperture 80, also as previously described, for exhausting cleaned air from the cyclone separation housing 58. As can be appreciated, any of the prior described vortex stabilizer surface configurations can be adapted for this embodiment. An annular debris outlet 79 is formed between an outer surface of the vortex stabilizer surface 74 and the perimeter wall of the cyclone separation housing 58. The upper edge of the cyclone separation housing 58 is tapered outwardly to assist in discharging the separated particles from the cyclone separation chamber. The cyclone separation housing 58 itself tapers inwardly from top to bottom to assist the collection of larger dirt particles in the dirt cup. The taper can be from 0 to 10 degrees.

In operation, where the arrows shown in FIG. 11 depict air flow through the cyclone module assembly 26, dirt laden air enters through the cyclone inlet 66 via the ramped scroll section 51 to simultaneously direct the air up a ramp section 53 to give the airflow a vertical and tangential path where it enters an interior surface of the cyclone separation housing 58 and spirals upward forming a vortex. The vortex tail is anchored on the vortex stabilizer surface 74 as previously described and abruptly changes direction and flows straight down through the outlet aperture 80 and into the fan/motor assembly 22. Debris is thrown up and out through the debris outlet 79 and comes to rest in the dirt collection region 97 formed between an outer wall of the cyclone separation housing 58 and an inner wall of the dirt cup housing 72. Debris captured within the dirt collection region 97 tends to remain static because there is relatively little air flow in the dirt collection region 97 and the debris falls under force of gravity to the lower surface of the debris collection area 97 out of the potentially turbulent air flow around the debris outlet 79. The dirt and debris collected in the dirt cup housing 72 is removed by removing the cover 73 and inverting the dirt cup assembly 60.

Figure 13:
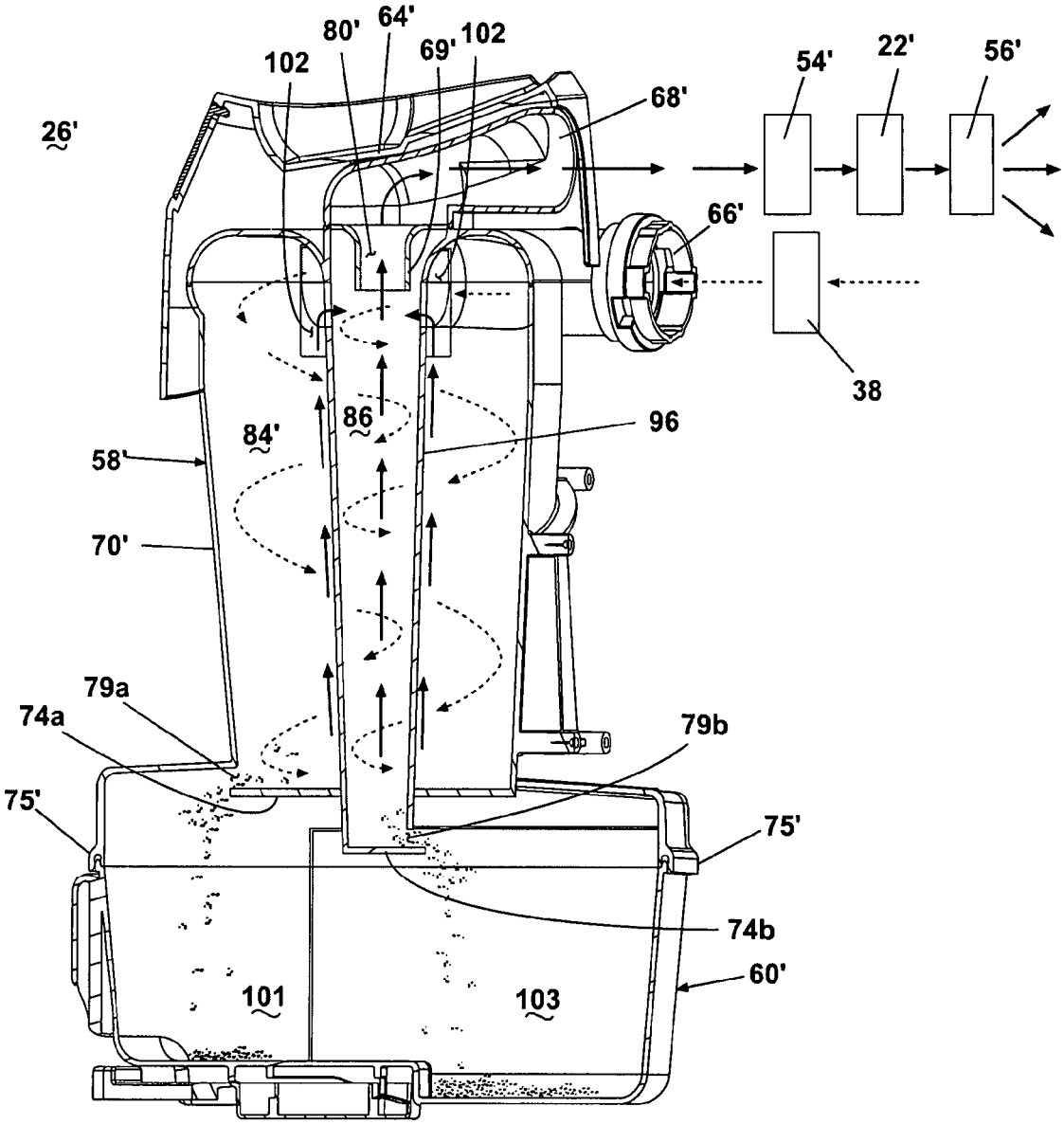
FIG. 13 is a cross-sectional view of a first embodiment of a concentric two-stage cyclone module assembly.

Referring to FIG. 13, a first embodiment of the concentric two-stage cyclone module assembly 26' is illustrated, where like features are indicated with the same numbers bearing a prime (') symbol. The cyclone module assembly 26' comprises a two-stage coaxial separator wherein a smaller frusto-conical separator 86 is positioned concentrically and in series downstream from an upstream separator 84'. The cyclone separation housing 58' comprises a first stage cyclone housing 70' fixedly attached to a cyclone inlet 66'. The cyclone housing 70' walls are generally inclined forming a generally frusto-conical shape whereby the bottom portion of the cyclone separation housing 58' has a smaller diameter than the upper portion. However, the cyclone housing 70' can be circular or an inverted frusto-conical shape depending upon manufacturing and aesthetic geometry desires. A frusto-conical shaped second stage cyclone housing 96 depends from an upper surface of the first stage cyclone housing 70'. A first stage debris outlet **79*a* is formed by a gap between a first stage vortex stabilizer surface 74*a* and the cyclone housing 70' wall. A second debris outlet 79*b* is formed by a gap between a second vortex stabilizer surface 74*b* and the frusto-conical second stage cyclone housing 96. A stabilizing rod as previously described can also be included on either or both stabilizer surfaces 74*a*, 74*b***.

A dirt cup assembly 60' is positioned below the cyclone separation housing 58' and is sealingly mated thereto. The dirt cup assembly 60' further comprises a first stage collection area 101 and a second stage collection area 103 that is sealed off from the first stage collection area 101. The dirt cup assembly 60' sealingly mates with the cyclone housing 70' via a lip 75' formed on a lower surface thereon. The second stage collection area 103 sealingly mates with a lower surface of the second stage cyclone housing 96 such that the second debris outlet **79*b* is in fluid communication therewith but is isolated from the first stage debris outlet 79*a***.

As indicated by the arrows, the fan/motor assembly 22' positioned downstream of the cyclone outlet 68' draws air from the cyclone inlet 66' into the cyclone housing 70' causing the air to swirl around the inner wall of the cyclone housing 70' of the single separator 84' where separation of larger debris occurs, the larger debris falling into the first stage collection area 101 of the dirt cup assembly 60'. The air then turns and travels up an outer surface of the second stage cyclone housing 96 where it enters the second stage separator via an inlet 102. The inlet 102 directs the air tangentially and downward along an inside surface of the second stage cyclone housing 96. The bottom of the second stage vortex in anchored on the second stage vortex stabilizer surface 74*b* where the airflow again turns and proceeds directly upward to the outlet aperture 80' formed by the vortex finder 69' and through the cyclone outlet 68'. The dirt removed by the frusto-conical separator 86 falls into the second stage collection area 103. The second stage collection area 103 can be formed completely within the outer wall of the first stage collection area 101. Alternatively, as shown in FIG. 13, the second stage collection area 103 can share a portion of the first stage collection area 101 wall so that the contents of the second stage collection area 103 is easily viewable to the user from outside the cyclone module 26'. The dirt cup assembly 60' is detached from the cyclone housing 70' and provides a clear, unobstructed path for the debris captured in both the first stage collection area 101 and the second stage collection area 103 to be dumped when the dirt cup assembly 60' is inverted.

As can be appreciated, the second stage cyclone can be positioned outside of and down stream from the first stage cyclone housing and can be oriented in any manner. Preferred orientations of the second stage collector relative to the first stage cyclone housing include adjacent side-by-side configurations, however the second stage collectors can also be aligned vertically as well as inclined up to and including angles of 90 degrees from vertical. Multiple downstream second stage or downstream cyclone modules arranged in series or parallel are also anticipated. Furthermore, any of the first stage cyclone or second stage cyclones can be oriented with the cyclone housing 70' taper in any direction. Taper direction is defined as the relationship between the larger diameter cyclone housing 70' end and the smaller diameter cyclone housing 70' end. A standard taper is one in which the larger end is above the smaller end. An inverted or reverse taper is formed when the smaller cyclone housing 70' end is above the larger cyclone housing 70' end.

Figure 16:
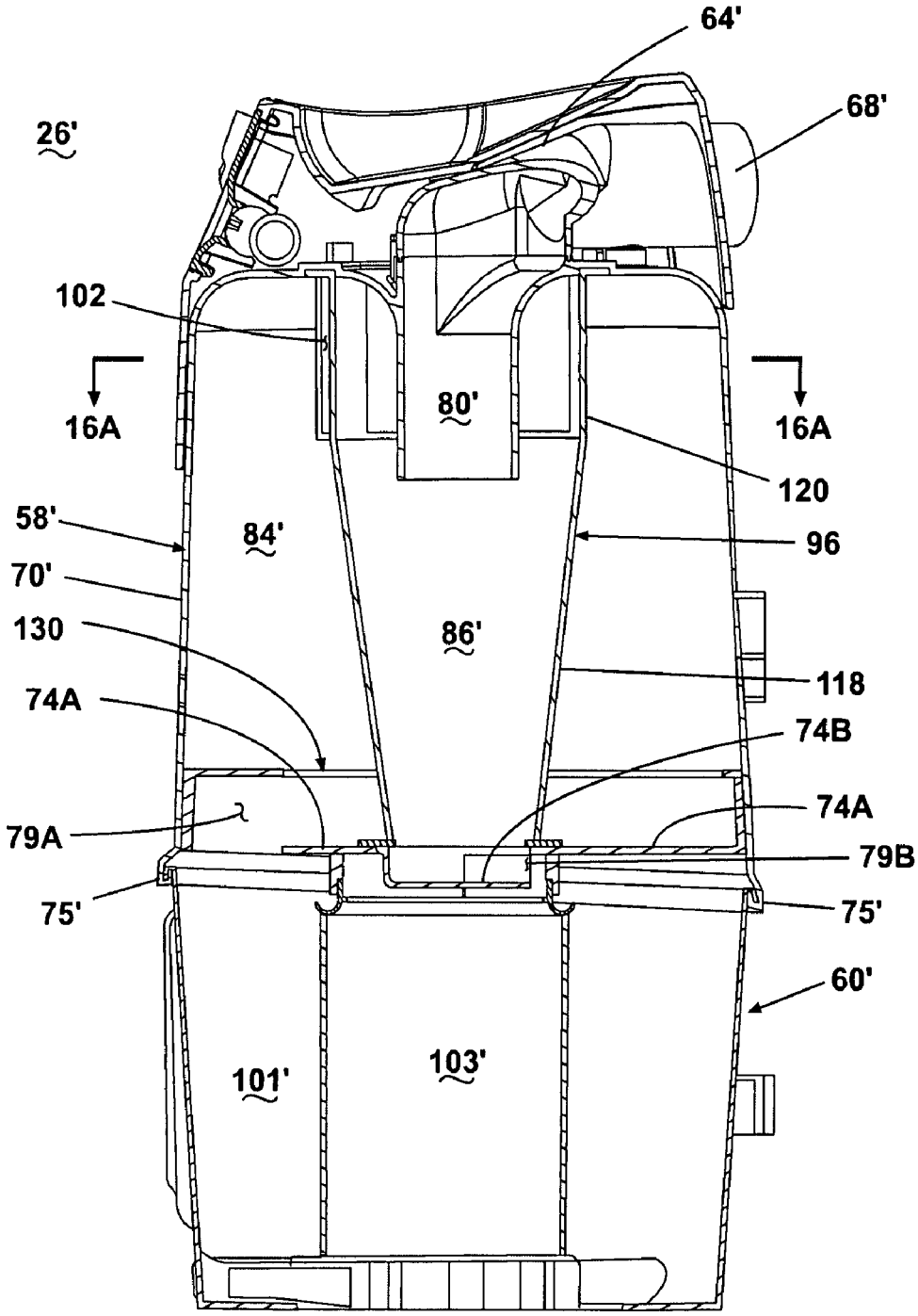
FIG. 16 is a cross-sectional view of a second embodiment of a concentric two-stage cyclone module assembly.
Figure 16A:
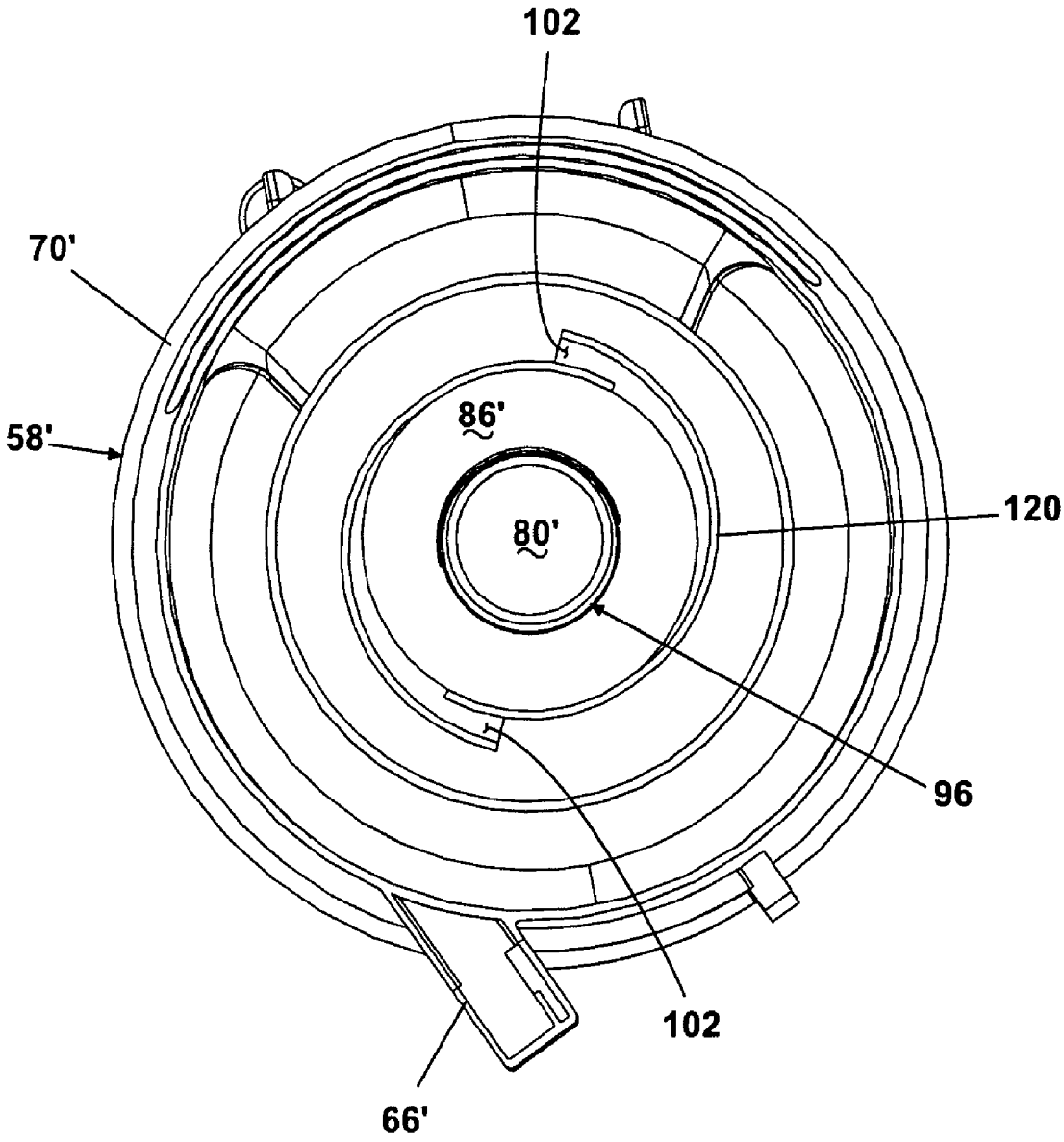
FIG. 16A is a cross-sectional view taken through line 16A-16A of FIG. 16.

Referring to FIG. 16, a second embodiment of the concentric two-stage cyclone module assembly 26' is illustrated, where like features are identified with the same numbers. In general, the second embodiment of the cyclone module assembly 26' differs from the first embodiment in that the second stage collection area 103 is positioned within and is generally coaxial with the first stage collection area 101. Another distinctive feature of the second embodiment of the cyclone module assembly 26' is that the second stage cyclone housing 96 comprises a lower frusto-conical section 118, a upper cylindrical section 120, and at least two inlets 102 formed in the upper cylindrical section 120 of the second stage cyclone housing 96. The upper cylindrical portion 120 has a larger diameter than the frusto-conical section 118 and thus the inlets 102 have a larger diameter than the frusto-conical section 118. Referring to FIG. 16A, the inlets 102 are symmetrically arranged on the upper cylindrical portion 120. In an alternate embodiment (not shown), the inlets 102 can be asymmetrically arranged on the upper cylindrical portion 120.

Figure 17:
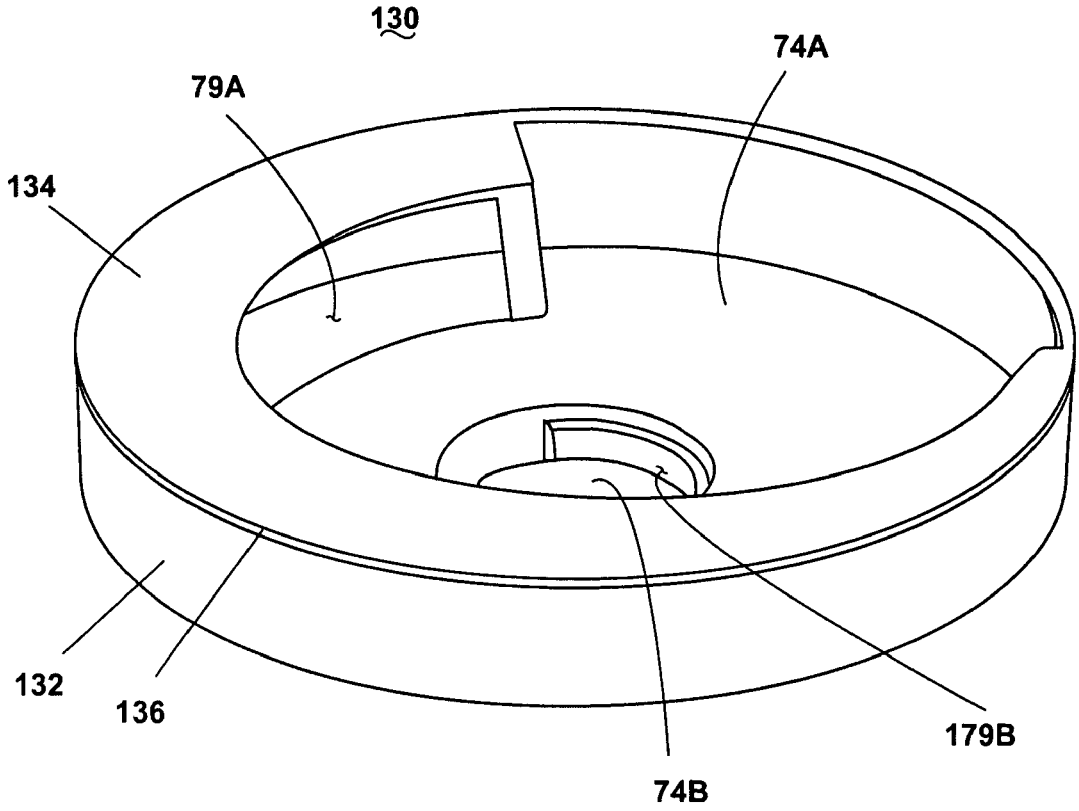
FIG. 17 is a perspective view of a integrally formed vortex stabilizer and gasket piece shown in FIG. 16.

Yet another distinctive feature of the second embodiment of the cyclone module assembly 26' is that the first and second stage vortex stabilizers 74A, 74B are integrally formed as a single piece 130 that is received between the dirt cup assembly 60' and the cyclone housing 70'. Referring additionally to FIG. 17, the single piece 130 is generally annular in shape and comprises an outer wall 132, an upper surface 134, a middle surface 74A forming the first stage vortex stabilizer, a lower surface 74B forming the second stage vortex stabilizer, an opening between the upper surface and the first stage vortex stabilizer surface 74A forming the first stage debris outlet 79A, and an opening between the first stage vortex stabilizer surface 74A and the second stage vortex stabilizer 74B forming the second stage debris outlet 79B. A gasket 136 is integrally formed at the edge between the outer surface 132 and the upper surface 134 and forms a seal between the dirt cup assembly 60' and the cyclone housing 70'. The single piece 130 can be integrally molded from a variety of materials, including thermoplastic and thermosetting material and preferably are elastomeric in nature.

Figure 14:
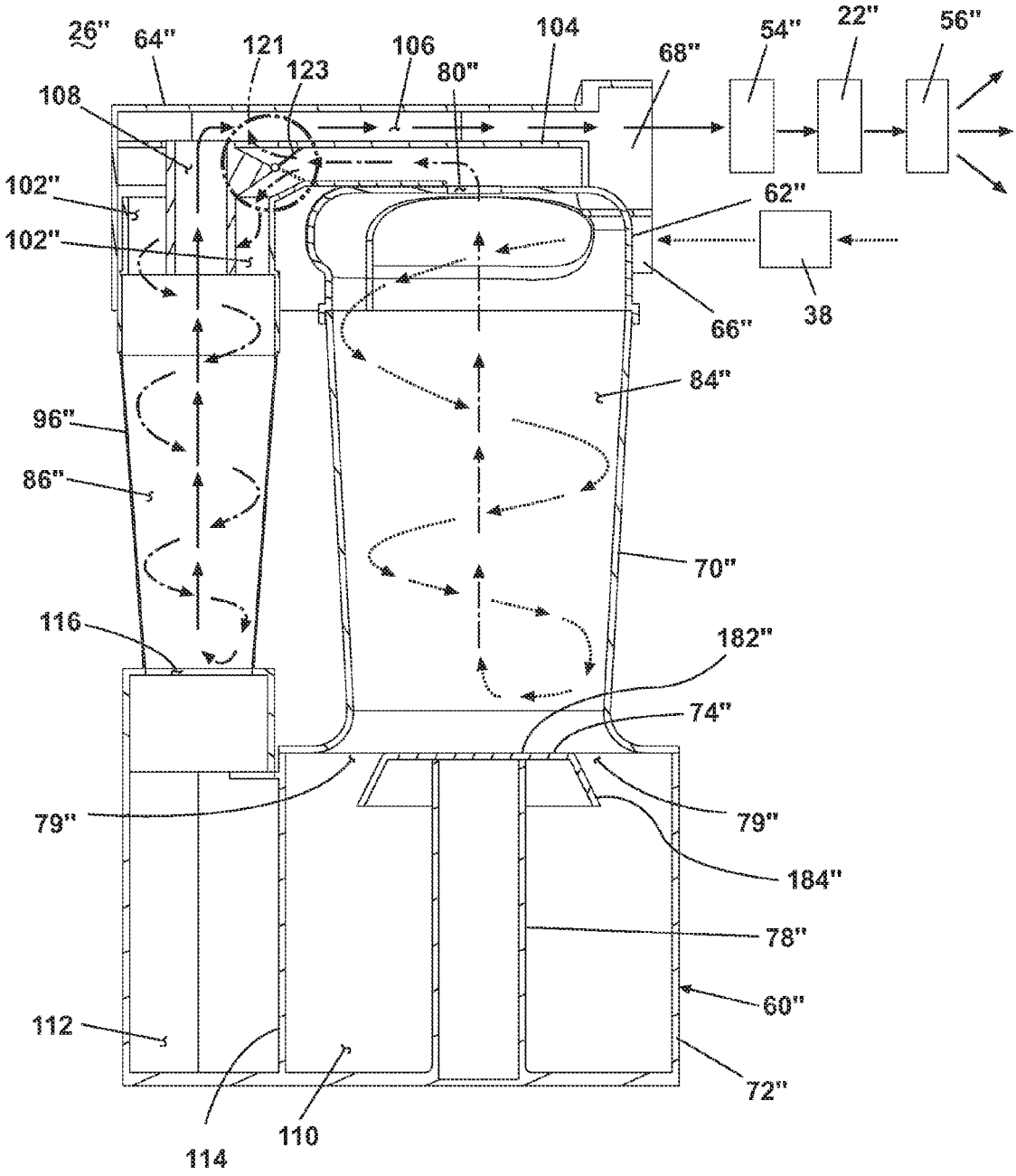
FIG. 14 is a cross-sectional view of a side-by-side two-stage cyclone module assembly.

Referring to FIG. 14, the side-by-side two-stage cyclone module assembly 26" is illustrated, where like features are identified with the same numbers bearing a double-prime (") symbol. In this embodiment, the cyclone module assembly 26" comprises a side-by-side two stage separator wherein a smaller frusto-conical separation stage 86" as previously described is positioned outside of and in series downstream from a cyclone separator 84". In this embodiment, the cyclone diffuser housing 64" is formed by a first stage cap 104 in spaced relation to a second stage diffuser 106. The first stage cap 104 covers the inlet housing outlet 80" and forms a plenum therebetween that is in fluid communication with the second stage inlet 102". The first stage cap 104 also comprises a second stage outlet aperture 108 that is in fluid communication with the second stage inlet 102". The second stage diffuser 106 covers the first stage cap 104 forming an outlet plenum therebetween.

The dirt cup assembly 60" comprises a first stage dirt cup 110 and a second stage dirt cup 112 that are joined by a dirt cup dividing wall 114. Both dirt cups 110, 112 are removed together as the dirt cup assembly 60" is removed and the contents of the dirt cups 110, 112 are emptied simultaneously. A vortex stabilizer surface 74" is positioned below the first stage cyclone housing 70" on a support member 78" extending vertically from the bottom of the first stage dirt cup 110. As illustrated, the vortex stabilizer surface 74" includes a generally flat plate 182" coupled to the support member 78" and having a downwardly-angled rim 184" at the outer edge of the plate 182". The plate 182" has a diameter less than that of the dirt cup 110. An annular debris outlet 79*a*" is formed between the vortex stabilizer surface 74" and an inner wall of the cyclone housing 70 whereby debris separated by the cyclone separator 84" can pass through to the first stage dirt cup 110. Another debris outlet 79*b*" formed in the bottom of the second stage cyclone housing 96" passes debris separated by the cyclone separator 86" through to the second stage dirt cup 112.

As indicated by the arrows, airflow exits the first stage separator through the inlet housing outlet 80" and enters the first plenum formed between a lower surface of the first stage cap 104 and an upper surface of the cyclone inlet housing 64". Air then travels to the second stage inlet 102" where the second cyclonic action occurs to remove additional fine debris from the airstream. Clean air exits the second stage separator 86" through the second stage outlet aperture 108 into an exhaust plenum formed between an upper surface of the first stage cap 104 and a lower surface of the second stage diffuser 106 where it exhausts the cyclone module assembly 26" at the cyclone outlet 68".

A cyclone selector 121 can be positioned between the inlet housing outlet 80" of the first cyclone housing 70" and the second stage inlet 102" of the second stage cyclone housing 96". The cyclone selector 121 further comprises a diverter valve 123 that is movable between a first position and a second position. The diverter valve 123 can be any commonly known air diverter switch such as a flap valve or sliding door arrangement as shown in U.S. Pat. No. 4,951,346 to Salmon which is incorporated herein by reference in its entirety. The diverter valve 123 can be actuated by the user to switch the air flow path by moving from the first position to the second position or vice versa. With the diverter 123 in the first position, as shown by the solid line, working air from the first cyclone housing 70" is directed to the second stage inlet 102" and through the second stage cyclone housing 96" as previously described. With the diverter 123 in the second position, as shown by the dashed line, working air from the first cyclone housing 70" is prevented from entering the second stage inlet 102", therefore bypassing the second stage cyclone housing 96 and is drawn directly into the motor/fan assembly 22". The cyclone selector 121 can be actuated in any commonly known manner including, but not limited to manual operation as shown in the Salmon patent or through the use of electric solenoid valves.

Figure 15:
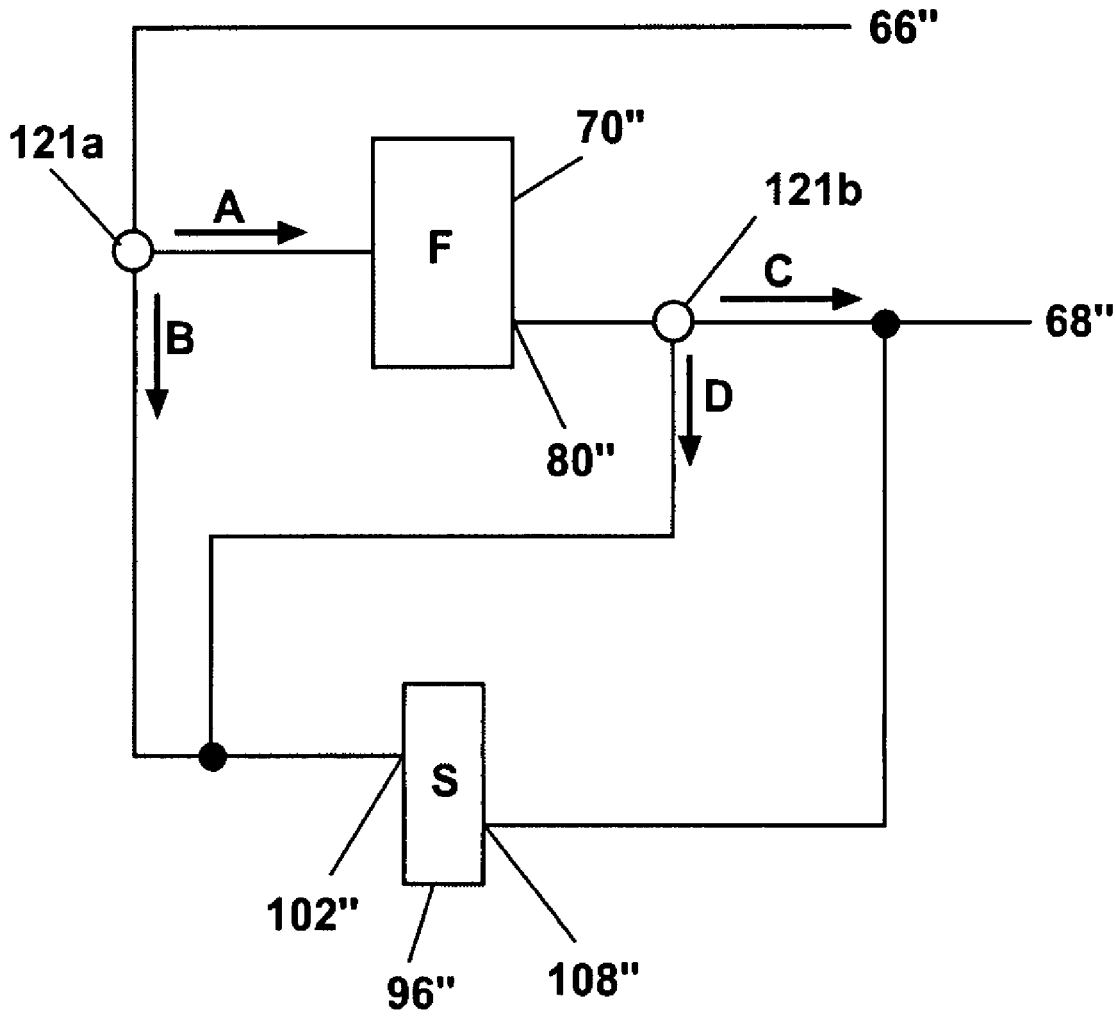
FIG. 15 is a schematic representation of an alternate embodiment of FIG. 14.

Referring to FIG. 15, in an alternate embodiment of the side-by-side two-stage cyclone module assembly 26", a pair of cyclone selectors 121*a* and 121*b* can be located so that the user can choose to operate the vacuum cleaner using only the first stage cyclone F, only the second stage cyclone S, or both cyclones in series. For example, the user can choose to use only the first stage cyclone F by positioning the selector 121*a* so that working air entering the cyclone inlet 66" flows into the first stage cyclone separator housing 70" by the first path (arrow A) and by positioning the selector 121*b* so that working air leaving the housing 70" exits the cyclone module assembly 26" through the cyclone outlet 68" by the first path (arrow C). In another example, the user can choose to use only the second stage cyclone S by positioning the selector 121*a* so that working air entering the cyclone inlet 66" flows into the second stage cyclone separator housing 96" by the second path (arrow B). In this case, working air bypasses the selector 121*b* and exits the cyclone module assembly 26" through the cyclone outlet 68" upon leaving the housing 96". In yet another example, the user can choose to use both cyclone stages F, S, by positioning the selector 121*a* so that working air entering the cyclone inlet 66" flows into the first stage cyclone separator housing 70" by the first path (arrow A) and by positioning the selector 121*b* so that working air leaving the housing 70" enters the second stage cyclone separator housing 96" by the second path (arrow D). The cyclone selectors 121*a* and 121*b* can be mechanically or electrically linked so that air flow through the selectors 121*a*, 121*b* can be directed as desired.

Figure 18:
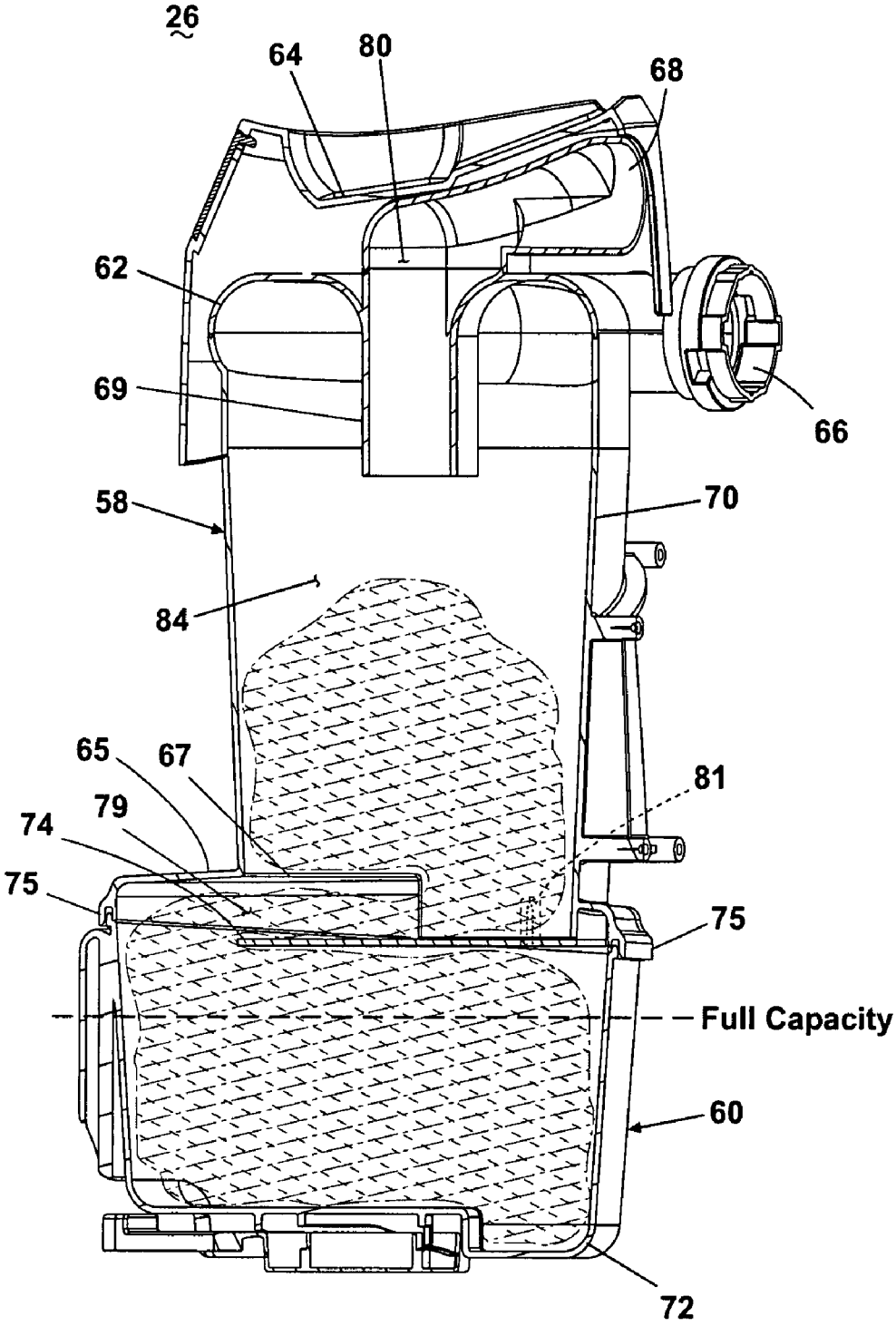
FIG. 18 is a cross-sectional view of the single stage cyclone module assembly of FIG. 8, illustrating the problem of overfilling the dirt cup assembly.

Referring to FIG. 18, the second embodiment of the single stage cyclone module assembly 26 is shown again to illustrate a problem that can occur when the dirt cup assembly 60 is not promptly emptied when it reaches its full capacity (generally indicated by the dotted line in FIG. 18). When the dirt cup housing 72 becomes full, it should be promptly removed from the vacuum cleaner 10 to be emptied. However, if the user neglects to empty the dirt cup housing 72 promptly when it becomes full, and continues to operate the vacuum cleaner 10 to clean a surface, dirt may continue to accumulate in the dirt cup housing 72. Once the dirt cup housing 72 is filled beyond its full capacity, dirt may begin to fill the cyclone housing 70.

Two problems can arise from not promptly emptying the dirt cup assembly 60 when it reaches full capacity. One problem is that dirt filling the cyclone housing 70 may enter the outlet aperture 80, thereby passing through the cyclone separation assembly 26 and clogging the airflow passageway through the vacuum cleaner 10 at or upstream of the pre-motor filter assembly 54. The other problem is that even if dirt collection has ceased before dirt enters the outlet aperture 80, the presence of a fixed vortex stabilizer 74 makes it difficult to empty dirt that has entered the cyclone housing 70 since the vortex stabilizer 74 holds dirt above the dirt cup housing 72. In this situation, it is nearly impossible to remove the dirt cup housing 72 from the vacuum cleaner 10 without making a mess since the dirt cup housing 72 is filled beyond full capacity. Also, dirt resting on the vortex stabilizer 74 is difficult to empty since the cyclone separation housing 58 is not easily removable from the vacuum cleaner 10.

Figure 19:
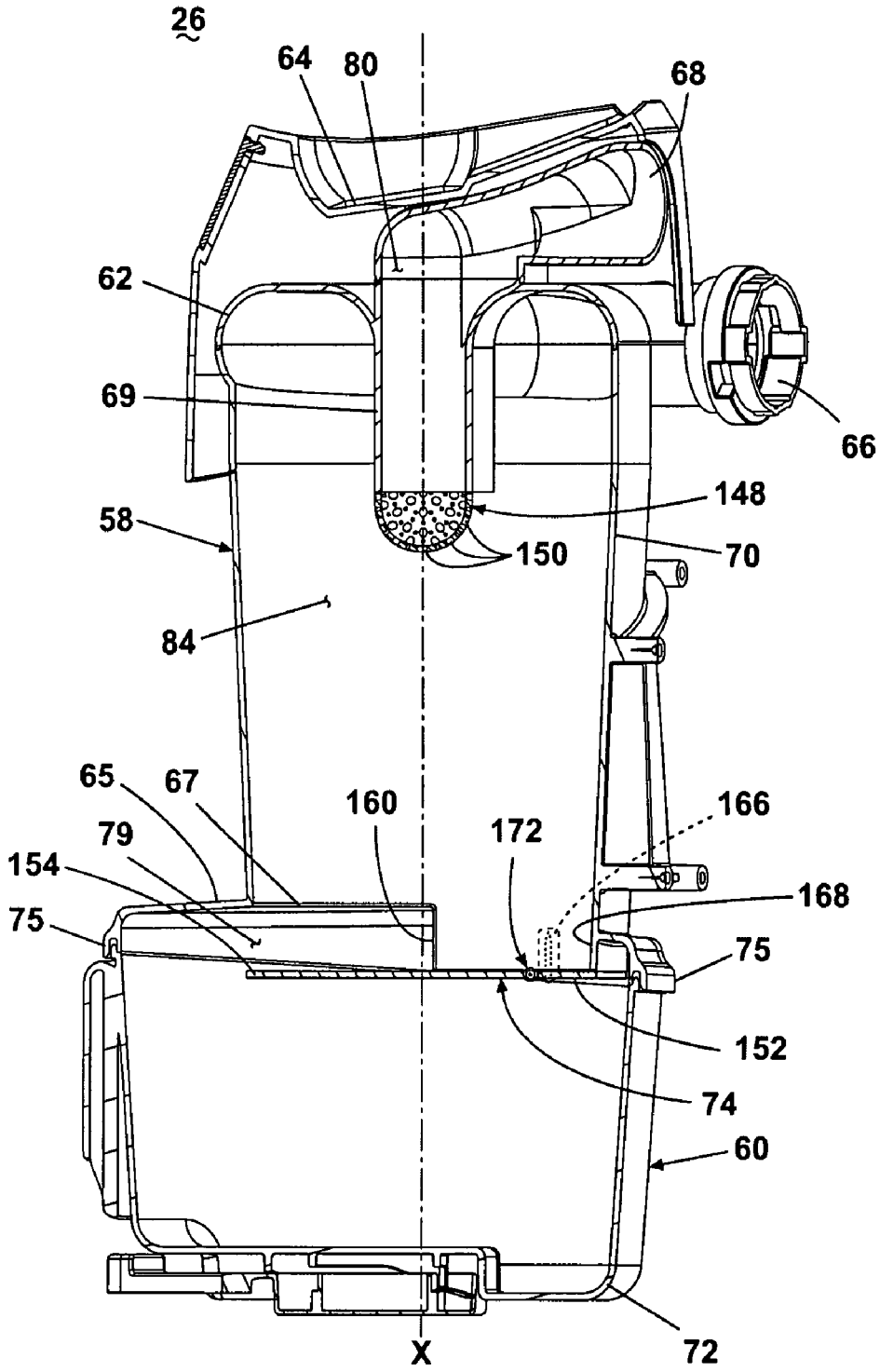
FIG. 19 is a cross-sectional view of the single stage cyclone module assembly of FIG. 18, with the vortex stabilizer in a closed position.

Referring to FIG. 19, a sixth embodiment of the single stage cyclone separator 26 is illustrated, where like parts are indicated with the like numbers. A solution to the first problem of dirt entering the outlet aperture 80 is solved by mounting a grill 148 over the open end of the vortex finder 69. As illustrated, the grill 148 is fixed to the lower end of the vortex finder 69 and prevents dirt in the cyclone housing 70 from entering the outlet aperture 80. The grill 148 can be hemispherical in shape and comprise a number of grill apertures 150 dispersed around the body of the hemispherical grill 148 through which air may pass. Other shapes for the grill 148, including, without limitation, flat plates, cylinders, and the like, can also be used.

Figure 20:
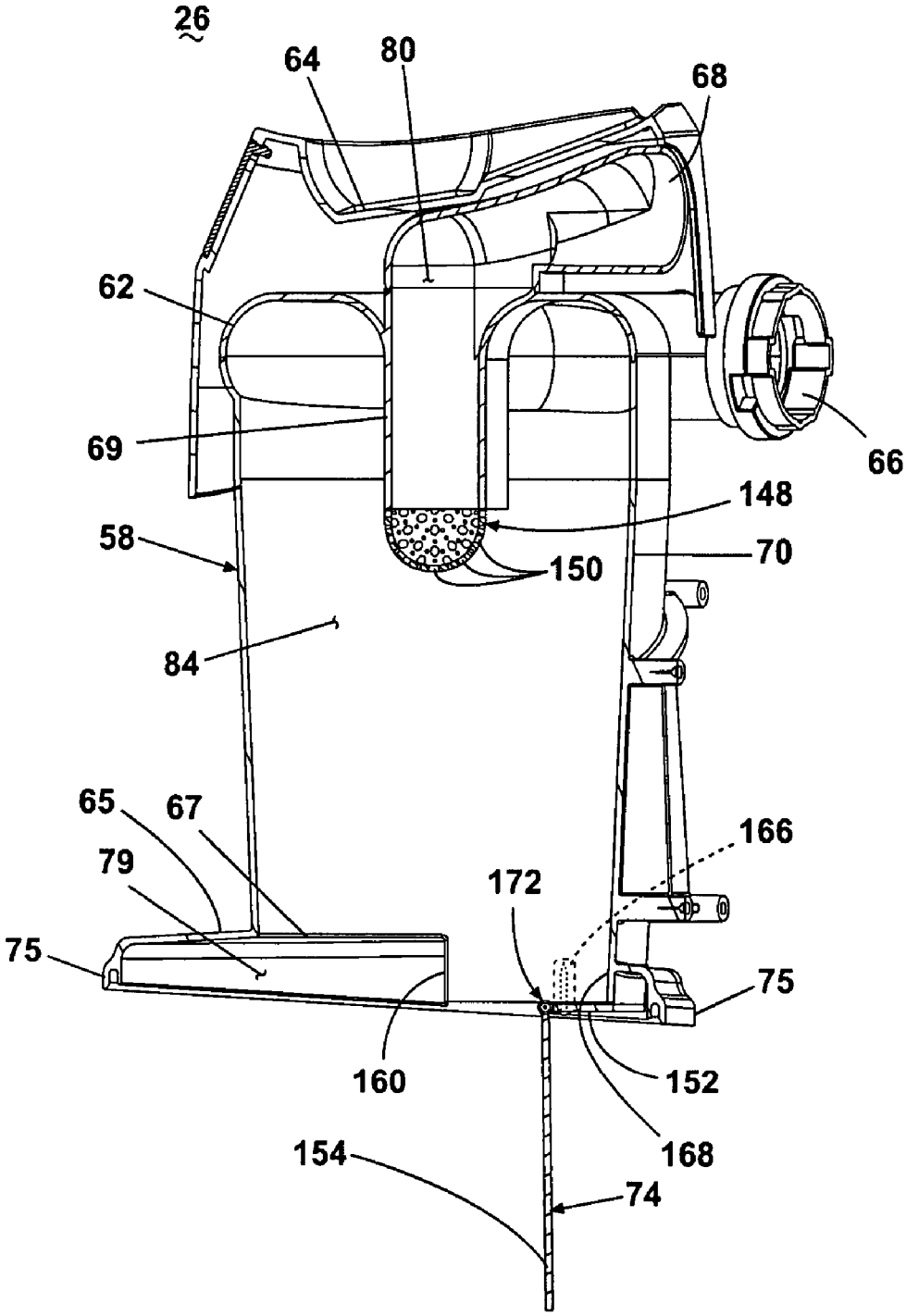
FIG. 20 is a cross-sectional view of the single stage cyclone module assembly of FIG. 18, with the dirt cup housing removed and the vortex stabilizer in an open position.

A solution to the second problem of emptying dirt atop the vortex stabilizer 74 is to pivotally mount the vortex stabilizer 74 to the cyclone separation housing 58. Referring to FIGS. 19 and 20, the vortex stabilizer 74 is moveable between a closed position, shown in FIG. 19, in which the vortex stabilizer 74 is transverse to a longitudinal axis X of the cyclone housing 70 and an open position, shown in FIG. 20, in which the cyclone housing 70 may be accessed. In the closed position the vortex stabilizer 74 is in an orientation in which a vortex tail may be retained. Also in the closed position, the vortex stabilizer 74 and the dirt cup lid 65 forms the debris outlet 79. In the open position, the vortex stabilizer 74 is in an orientation in which the vortex stabilizer 74 is pivoted away from the center of the cyclone separation housing 58 so that any dirt atop the vortex stabilizer 74 can fall freely into a waste receptacle, and the user may access the inside of the cyclone housing 70, including the grill 148.

As illustrated, the vortex stabilizer 74 comprises a stationary portion 152 and a moveable portion 154 that can be rotated relative to the stationary portion 152 to effect movement of the vortex stabilizer 74 between the open and closed positions. The stationary portion 152 and the moveable portion 154 each comprise a semicircular flat plate that together form a generally circular shape when the vortex stabilizer 74 is in the closed position.

Figure 21:
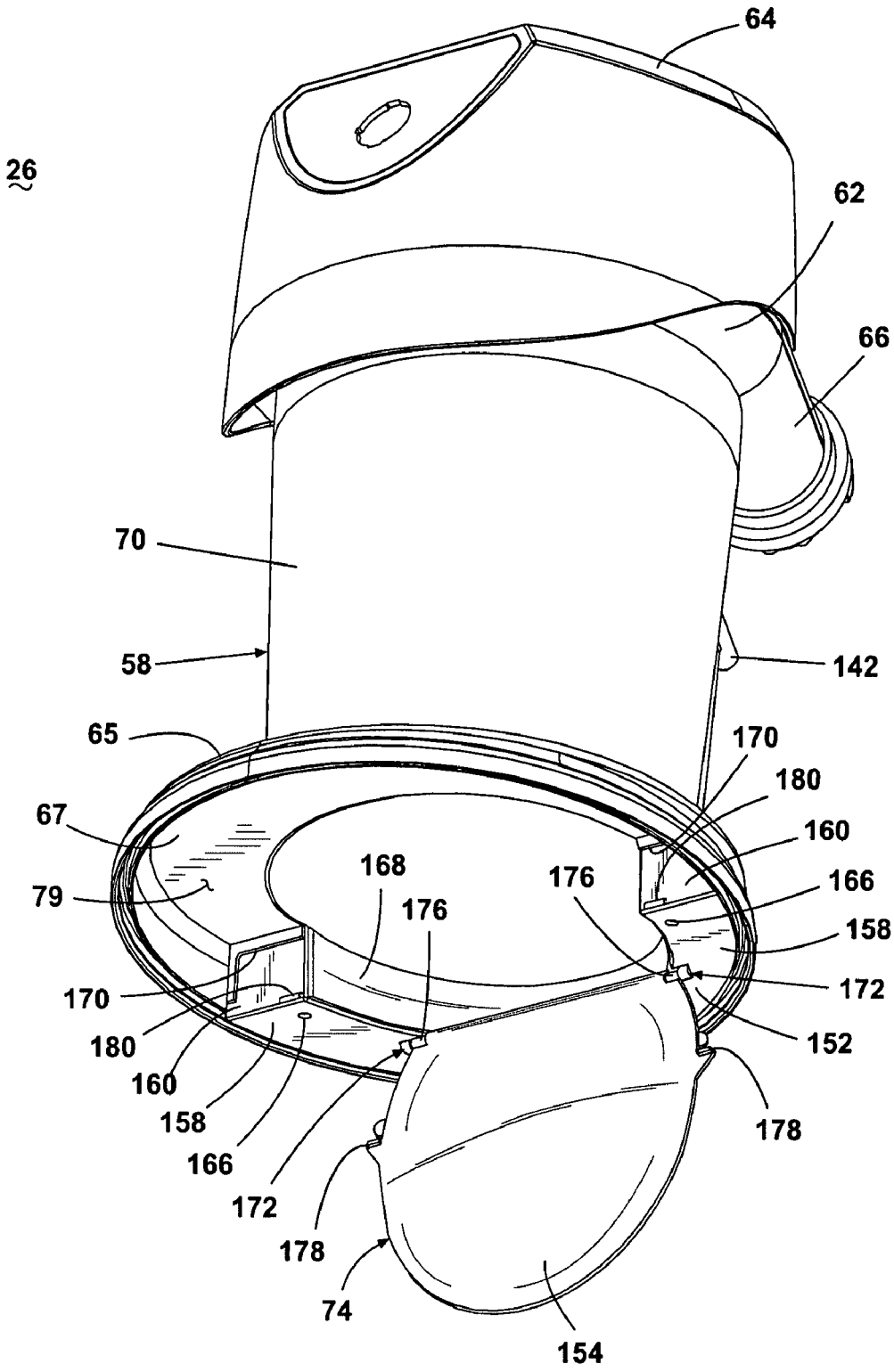
FIG. 21 is a bottom perspective view of the single stage cyclone module assembly of FIG. 18, with the dirt cup housing removed and the vortex stabilizer in an open position.
Figure 22:
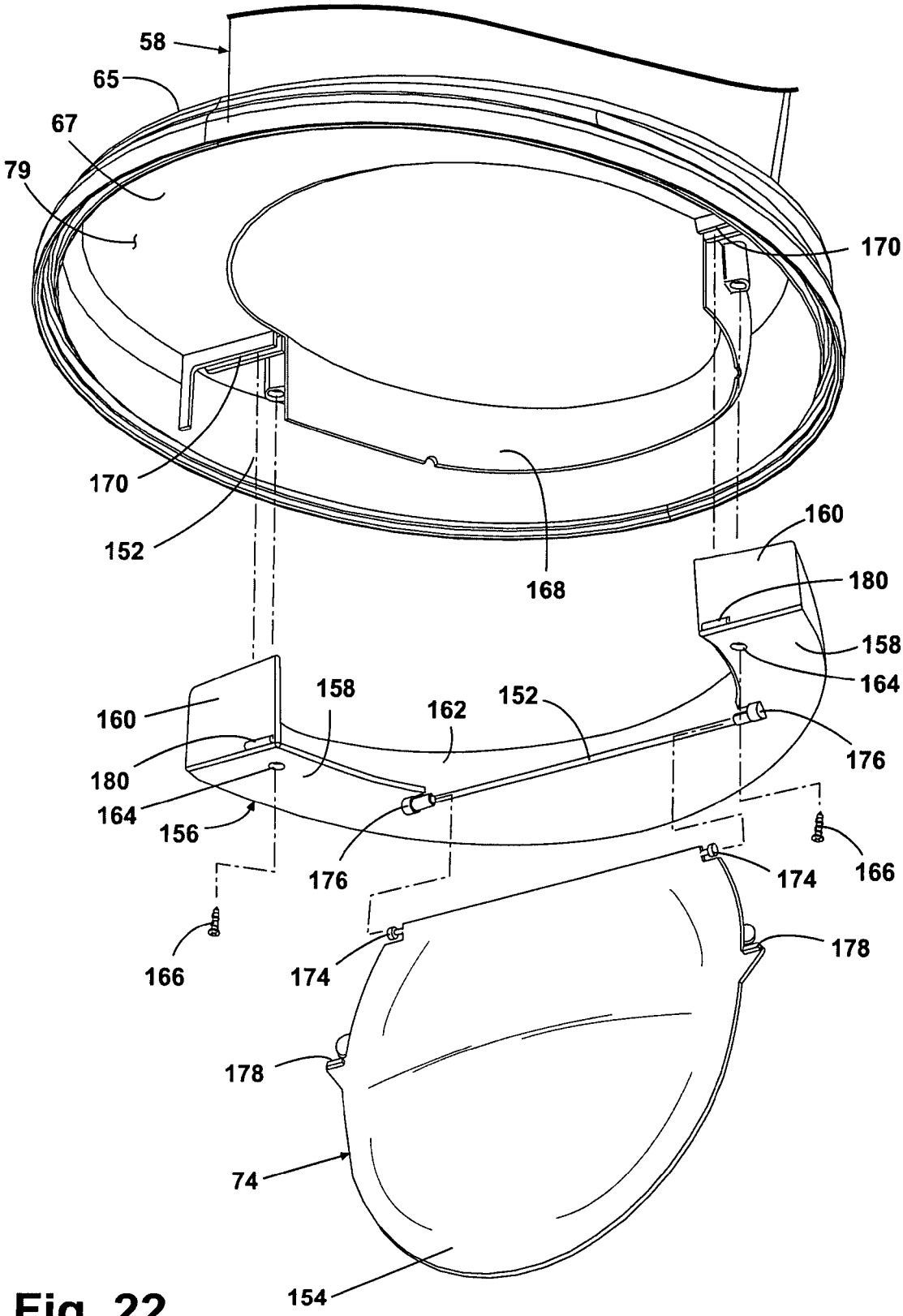
FIG. 22 is a partial exploded view of the single stage cyclone module assembly of FIGS. 18-21.

Referring to FIGS. 21 and 22, the stationary portion 152 can be integrally formed with the cyclone separation housing 58, or can be separately attached thereto. In the illustrated embodiment, the stationary portion 152 can be formed as part of an insert 156 that serves to attach the vortex stabilizer 74 to the cyclone separation housing 58. In addition to the stationary portion 152, the insert 156 comprises a pair of attachment wings 158 integrally formed with the stationary portion 152, a pair of end walls 160 orthogonally formed with the attachment wings 158 and an arcuate wall 162 extending between the end walls 160 and joined orthogonally with the stationary portion 152 and the attachment wings 158.

Each attachment wing 158 comprises a screw boss 164 for receiving a screw 166 that suspends the insert 156, and thus the entire vortex stabilizer 74, from the dirt cup lid 65, which is integrally formed with the cyclone separation housing 58.

Therefore, the vortex stabilizer surface 74 stays with the cyclone housing 70 when the dirt cup housing 72 is removed.

When the insert 156 is fixed to the dirt cup lid 65, the arcuate wall 162 of the insert 156 is received between the dirt cup lid 65 and an arcuate wall 168 depending from the lower portion of the cyclone housing 70. The arcuate wall 168 is spaced from the dirt cup lid 65 and is joined with two grooves 170 that receive the end walls 160 of the insert 156. When the insert 156 is in position, the stationary portion 152 of the vortex stabilizer 74 extends orthogonally from the arcuate wall 168 toward the grooves 170.

The moveable portion 154 is rotatably attached to the insert 156 by a pivot assembly 172. The pivot assembly 172 comprises a pair of opposed pivot shafts 174 formed on the moveably portion 154 that are received by a corresponding pair of opposed pivot sleeves 176 formed on the stationary portion 152 of the insert 156.

The vortex stabilizer can be releasably retained in the closed portion shown in FIG. 19 by a detent mechanism. As illustrated, the moveable portion 154 comprises a pair of tabs 178 that engage a corresponding pair of detents 180 formed on the end walls 160 of the insert 156. The moveable portion 154 can be mounted to the insert 156 by a variety of different known mounting mechanisms that removably mount the two parts together for selective removal for emptying any accumulated dirt on the vortex stabilizer 74.

As is evident from the foregoing description of the sixth embodiment of the single stage cyclone separator 26, the passage of debris through the outlet aperture 80 can be avoided by positioning the grill 148 between the outlet aperture 80 and the cyclone housing 70 and the pivotal vortex stabilizer 74. The grill 148 prevents dirt in the cyclone housing 70 from passing through the cyclone separation assembly 26. The pivotal vortex stabilizer 74 allows the inside of the cyclone housing 70 to be accessed.

While the invention has been specifically described in connection with certain specific embodiments thereof, it is to be understood that this is by way of illustration and not of limitation. It is anticipated that the cyclone separators described herein can be utilized for both dry and wet separation. Furthermore, the features described can be applied to any cyclone separation device utilizing a single cyclone, or two or more cyclones arranged in any combination of series or parallel airflows. In addition, whereas the invention has been described with respect to an upright vacuum cleaner, the invention can also be used with other forms of vacuum cleaners, such as canister or central vacuum cleaners. Reasonable variation and modification are possible within the forgoing disclosure and drawings without departing from the spirit of the invention which is defined in the appended claims.

What is claimed is:

1. A vacuum cleaner comprising:

a cleaning head assembly having a suction nozzle;

a suction source; and a cyclone module assembly in fluid communication with the suction nozzle and the suction source, and comprising:

a cyclone separation chamber for separating dust and debris from air with the generation of a cyclonic airflow vortex forming a vortex tail, the cyclone separation chamber having an inlet opening in fluid communication with the suction nozzle through the working air path, an outlet opening for discharging cleaned air and a particle discharge outlet for discharging dust and debris separated from air;

a dirt cup removably mounted to the cyclone separation chamber and in fluid communication with the particle discharge outlet for collecting dust and debris that is separated from the air in the cyclone separation chamber; and a vortex stabilizer selectively mounted with respect to the cyclone separation chamber for movement between a closed position at a predetermined location with respect to the cyclone separation chamber and an open position away from the closed position for access to the cyclone separation chamber to remove any accumulated dust and debris that remains on the vortex stabilizer after a cleaning operation.

2. The vacuum cleaner according to claim 1 wherein the vortex stabilizer closed position is transverse to a longitudinal axis of the cyclone separation chamber.

3. The vacuum cleaner according to claim 2 wherein a bottom portion of the cyclone separation chamber and the vortex stabilizer together form the particle discharge outlet, when the vortex stabilizer is in the closed position.

4. The vacuum cleaner according to claim 2 and further comprising a detent for releasably retaining the vortex stabilizer in the closed position.

5. The vacuum cleaner according to claim 1 and further comprising a grill on the outlet opening of the cyclone separation chamber for preventing dust and debris from entering the outlet opening.

6. The vacuum cleaner according to claim 5 wherein the outlet opening is defined by a tubular conduit that has an open end and the grill is mounted on the open end of the tubular conduit.

7. The vacuum cleaner according to claim 1 wherein the vortex stabilizer is offset with respect to a vertical centerline of the dirt cup.

8. The vacuum cleaner according to claim 7 wherein a vertical centerline of the cyclone separation chamber is offset with respect to the vertical centerline of the dirt cup.

9. The vacuum cleaner according to claim 1 wherein the vortex stabilizer is suspended from at least one wall affixed to the cyclone separation chamber.

10. The vacuum cleaner according to claim 1 wherein a portion of the vortex stabilizer is stationary regardless of whether the vortex stabilizer is in the closed or open position.

11. The vacuum cleaner according to claim 1 wherein the vortex stabilizer is adjacent the particle discharge outlet.

12. The vacuum cleaner according to claim 11 wherein the particle discharge outlet is formed by a gap in a lower portion of the side wall of the cyclone separation chamber.

13. The vacuum cleaner according to claim 1 wherein the vortex stabilizer comprises a flat surface.

14. The vacuum cleaner according to claim 1 wherein one and only one particle discharge outlet is present in the cyclone separation chamber.

15. The vacuum cleaner according to claim 1 wherein at least of a portion of the vortex stabilizer is pivotally mounted to the cyclone separation chamber.

16. A vacuum cleaner comprising:

a cleaning head assembly having a suction nozzle;

a suction source; and a cyclone module assembly in fluid communication with the suction nozzle and the suction source, and comprising:

a cyclone separation chamber for separating dust and debris from air with the generation of a cyclonic airflow vortex forming a vortex tail, the cyclone separation chamber having an inlet opening in fluid communication with the suction nozzle through the working air path, an outlet opening for discharging cleaned air and a particle discharge outlet for discharging dust and debris separated from air;

a dirt cup in fluid communication with the particle discharge outlet for collecting dust and debris that is separated from the air in the cyclone separation chamber; and a vortex stabilizer mounted on a support member that extends upwardly from a bottom surface of the dirt cup to retain the vortex tail at a predetermined location with respect to the cyclone separation chamber, the vortex stabilizer comprising:

a generally flat plate mounted on top of the support member and having a diameter less than a diameter of the dirt cup; and a downwardly angled rim at an outer edge of the plate.

17. A vacuum cleaner comprising:

a cleaning head assembly having a suction nozzle;

a suction source; and a cyclone module assembly in fluid communication with the suction nozzle and the suction source, and comprising:

a cyclone separation chamber for separating dust and debris from air with the generation of a cyclonic airflow vortex forming a vortex tail, the cyclone separation chamber having an inlet opening in fluid communication with the suction nozzle through the working air path, an outlet opening for discharging cleaned air and a particle discharge outlet for discharging dust and debris separated from air;

a dirt cup in fluid communication with the particle discharge outlet for collecting dust and debris that is separated from the air in the cyclone separation chamber; and a vortex stabilizer to retain the vortex tail at a predetermined location with respect to the cyclone separation chamber;

wherein at least one of the size and orientation of the vortex stabilizer is adjustable with respect to the particle discharge outlet.

18. A vacuum cleaner comprising:

a cleaning head assembly having a suction nozzle;

a suction source; and a cyclone module assembly in fluid communication with the suction nozzle and the suction source, and comprising:

a cyclone separation chamber for separating dust and debris from air with the generation of a cyclonic airflow vortex forming a vortex tail, the cyclone separation chamber having an inlet opening in fluid communication with the suction nozzle through the working air path, an outlet opening for discharging cleaned air and a particle discharge outlet for discharging dust and debris separated from air;

a dirt cup in fluid communication with the particle discharge outlet for collecting dust and debris that is separated from the air in the cyclone separation chamber; and a flexible vortex stabilizer to retain the vortex tail at a predetermined location with respect to the cyclone separation chamber.

19. The vacuum cleaner according to claim 18 wherein the flexible material is an elastomeric material.

* * * * *